US011300259B1

(12) United States Patent
Cohen

(10) Patent No.: US 11,300,259 B1
(45) Date of Patent: Apr. 12, 2022

(54) DOWNLIGHT MODULE WITH EXTENDABLE LENS

(71) Applicant: Brandon Cohen, Vernon, CA (US)

(72) Inventor: Brandon Cohen, Vernon, CA (US)

( * ) Notice: Subject to any disclaimer, the term of this patent is extended or adjusted under 35 U.S.C. 154(b) by 0 days.

(21) Appl. No.: 17/364,742

(22) Filed: Jun. 30, 2021

(51) Int. Cl.

| | |
|---|---|
| ***F21S 8/02*** | (2006.01) |
| ***F21V 17/02*** | (2006.01) |
| ***F21V 29/76*** | (2015.01) |
| ***F21V 19/00*** | (2006.01) |
| ***F21V 23/00*** | (2015.01) |
| ***F21V 5/00*** | (2018.01) |
| ***F21V 17/12*** | (2006.01) |
| ***F21Y 115/10*** | (2016.01) |

(52) U.S. Cl.
CPC ..... *F21S 8/02* (2013.01); *F21V 5/008* (2013.01); *F21V 17/02* (2013.01); *F21V 17/12* (2013.01); *F21V 19/003* (2013.01); *F21V 23/003* (2013.01); *F21V 29/763* (2015.01); *F21Y 2115/10* (2016.08)

(58) Field of Classification Search
CPC .. F21S 8/02; F21V 5/008; F21V 17/02; F21V 17/12; F21V 19/003; F21V 23/003; F21V 29/763
See application file for complete search history.

(56) References Cited

U.S. PATENT DOCUMENTS

| | | | |
|---|---|---|---|
| 1,133,535 | A | 3/1915 | Cain |
| 1,471,340 | A | 10/1923 | Knight |
| 1,856,356 | A | 5/1932 | Owen |
| 2,352,913 | A | 7/1944 | Parker |
| 2,758,810 | A | 8/1956 | Good |
| 2,802,933 | A | 8/1957 | Broadwin |
| 3,104,087 | A | 9/1963 | Budnick |
| 3,773,968 | A | 11/1973 | Copp |

(Continued)

FOREIGN PATENT DOCUMENTS

| | | | |
|---|---|---|---|
| EP | 3521688 | A1 | 7/2019 |
| KR | 20100124063 | A * | 11/2010 |

(Continued)

OTHER PUBLICATIONS

US 10,816,169 B1, 10/2020, Danesh (withdrawn)

(Continued)

*Primary Examiner* — Alan B Cariaso
(74) *Attorney, Agent, or Firm* — Eric Kelly

(57) ABSTRACT

A downlight module with an extendable lens may have a heat sink module, a top (inner) cylinder, a bottom (outer) telescopic cylinder, a telescopic holder, a fixed lens, and the extendable lens. The top (inner) cylinder may be attached to a bottom-portion of the heat sink module. The bottom (outer) telescopic cylinder may be operatively linked to the top (inner) cylinder, such that the bottom (outer) telescopic cylinder is movable up or down. The fixed lens may be fixedly positioned within an internal cavity of the bottom-portion. The extendable lens may be located within the bottom (outer) telescopic cylinder that is translatable. The telescopic holder may be a sleeve that fixedly attaches to an exterior of the bottom-portion and covers all of the fixed lens and the top (inner) cylinder. The bottom (outer) telescopic cylinder may extend beyond the telescopic holder. A LED light source may be included.

20 Claims, 19 Drawing Sheets

(56) References Cited

U.S. PATENT DOCUMENTS

| | | | | |
|---|---|---|---|---|
| 3,913,773 | A | 10/1975 | Copp | |
| 4,880,128 | A | 11/1989 | Jorgensen | |
| 4,919,292 | A | 4/1990 | Hsu | |
| 5,303,894 | A | 4/1994 | Deschamps | |
| 5,420,376 | A | 5/1995 | Rajecki | |
| 5,957,573 | A | 9/1999 | Wedekind | |
| 6,521,833 | B1 | 2/2003 | DeFreitas | |
| 6,967,284 | B1 | 11/2005 | Gretz | |
| D606,696 | S | 12/2009 | Chen | |
| 7,784,754 | B2 | 8/2010 | Nevers | |
| 7,857,275 | B2 | 12/2010 | de la Borbolla | |
| 7,950,832 | B2 | 5/2011 | Tanaka | |
| D640,819 | S | 6/2011 | Pan | |
| D656,263 | S | 3/2012 | Ogawa | |
| 8,235,549 | B2 | 8/2012 | Gingrich, III | |
| D668,372 | S | 10/2012 | Renshaw | |
| 8,322,897 | B2 | 12/2012 | Blincoe | |
| D682,459 | S | 5/2013 | Gordin | |
| 8,545,064 | B2 | 10/2013 | Blincoe | |
| D694,456 | S | 11/2013 | Rowlette, Jr. | |
| D708,381 | S | 7/2014 | Rashidi | |
| 8,845,144 | B1 | 9/2014 | Davis | |
| D714,989 | S | 10/2014 | Rowlette, Jr. | |
| 8,926,133 | B2 | 1/2015 | Booth | |
| D726,949 | S | 4/2015 | Redfern | |
| 9,039,254 | B2 | 5/2015 | Danesh | |
| D734,525 | S | 7/2015 | Gordin | |
| 9,151,457 | B2 | 10/2015 | Pickard | |
| 9,222,651 | B1 * | 12/2015 | Vlad | F21V 17/164 |
| 9,404,639 | B2 | 8/2016 | Bailey | |
| 9,523,493 | B2 | 12/2016 | Chen | |
| D777,967 | S | 1/2017 | Redfern | |
| D779,100 | S | 2/2017 | Redfern | |
| 9,581,302 | B2 | 2/2017 | Danesh | |
| 9,605,842 | B1 | 3/2017 | Davis | |
| D790,102 | S | 6/2017 | Guzzini | |
| 9,673,597 | B2 | 6/2017 | Lee | |
| 9,696,021 | B2 | 7/2017 | Wronski | |
| 9,797,562 | B2 | 10/2017 | Dabiet | |
| 9,854,642 | B2 | 12/2017 | Kashani | |
| 9,890,942 | B2 | 2/2018 | Lin | |
| 9,945,548 | B2 | 4/2018 | Williams | |
| 9,964,266 | B2 | 5/2018 | Danesh | |
| D820,494 | S | 6/2018 | Cohen | |
| 10,072,805 | B2 | 9/2018 | Bailey | |
| D832,218 | S | 10/2018 | Wronski | |
| D833,977 | S | 11/2018 | Danesh | |
| 10,139,059 | B2 | 11/2018 | Danesh | |
| 10,244,607 | B1 | 3/2019 | Kashani | |
| D847,414 | S | 4/2019 | Danesh | |
| D847,415 | S | 4/2019 | Danesh | |
| 10,247,390 | B1 | 4/2019 | Kopitzke | |
| D848,375 | S | 5/2019 | Danesh | |
| D851,046 | S | 6/2019 | Peng | |
| 10,378,738 | B1 | 8/2019 | Davis | |
| 10,408,395 | B2 | 9/2019 | Danesh | |
| 10,408,396 | B2 | 9/2019 | Wronski | |
| D864,877 | S | 10/2019 | Danesh | |
| 10,488,000 | B2 | 11/2019 | Danesh | |
| 10,551,044 | B2 | 2/2020 | Peng | |
| 10,563,850 | B2 | 2/2020 | Danesh | |
| D877,957 | S | 3/2020 | Kopitzke | |
| 10,591,120 | B2 | 3/2020 | Bailey | |
| 10,609,785 | B1 | 3/2020 | Fardadi | |
| 10,616,968 | B2 | 4/2020 | Wang | |
| 10,663,127 | B2 | 5/2020 | Danesh | |
| 10,663,153 | B2 | 5/2020 | Nikooyan | |
| 10,753,558 | B2 | 8/2020 | Danesh | |
| 10,805,997 | B2 | 10/2020 | Wang | |
| 10,816,148 | B2 | 10/2020 | Danesh | |
| D901,398 | S | 11/2020 | Danesh | |
| D902,871 | S | 11/2020 | Danesh | |
| D903,605 | S | 12/2020 | Danesh | |
| D905,327 | S | 12/2020 | Williams | |
| D907,284 | S | 1/2021 | Danesh | |
| 10,975,570 | B2 | 4/2021 | Shen | |
| 10,982,829 | B2 | 4/2021 | Danesh | |
| 10,989,390 | B2 | 4/2021 | Lotfi | |
| 11,022,259 | B2 | 6/2021 | Bailey | |
| 11,028,982 | B2 | 6/2021 | Danesh | |
| 11,047,538 | B2 | 6/2021 | Danesh | |
| D924,467 | S | 7/2021 | Danesh | |
| D925,109 | S | 7/2021 | Danesh | |
| 11,060,705 | B1 | 7/2021 | Danesh | |
| 11,067,231 | B2 | 7/2021 | Lotfi | |
| 11,085,597 | B2 | 8/2021 | Danesh | |
| 11,118,768 | B2 | 9/2021 | Danesh | |
| 2014/0254177 | A1 | 9/2014 | Danesh | |
| 2015/0009676 | A1 | 1/2015 | Danesh | |
| 2015/0233556 | A1 | 8/2015 | Danesh | |
| 2015/0276185 | A1 | 10/2015 | Bailey | |
| 2016/0312987 | A1 | 10/2016 | Danesh | |
| 2016/0348860 | A1 | 12/2016 | Bailey | |
| 2016/0348861 | A1 | 12/2016 | Bailey | |
| 2017/0005460 | A1 | 1/2017 | Lee | |
| 2017/0045213 | A1 | 2/2017 | Williams | |
| 2017/0138576 | A1 | 5/2017 | Peng | |
| 2017/0167672 | A1 | 6/2017 | Stauner | |
| 2017/0167699 | A1 | 6/2017 | Schubert | |
| 2017/0284649 | A1 * | 10/2017 | Ouellet | F21K 9/237 |
| 2017/0290129 | A1 | 10/2017 | Kashani | |
| 2018/0119925 | A1 * | 5/2018 | Yamae | G02B 27/0938 |
| 2018/0231197 | A1 | 8/2018 | Danesh | |
| 2018/0372284 | A1 | 12/2018 | Danesh | |
| 2019/0049080 | A1 | 2/2019 | Danesh | |
| 2019/0063701 | A1 | 2/2019 | Lotfi | |
| 2019/0093836 | A1 | 3/2019 | Danesh | |
| 2019/0394849 | A1 | 12/2019 | Wang | |
| 2020/0056752 | A1 | 2/2020 | Danesh | |
| 2020/0116340 | A1 | 4/2020 | Nikooyan | |
| 2020/0158302 | A1 | 5/2020 | Danesh | |
| 2020/0232624 | A1 | 7/2020 | Lotfi | |
| 2020/0236755 | A1 | 7/2020 | Wang | |
| 2020/0291652 | A1 | 9/2020 | Shen | |
| 2020/0348000 | A1 | 11/2020 | Bailey | |
| 2020/0386375 | A1 | 12/2020 | Danesh | |
| 2020/0393118 | A1 | 12/2020 | Danesh | |
| 2020/0393119 | A1 * | 12/2020 | Portinga | F21V 7/0091 |
| 2021/0010647 | A1 | 1/2021 | Danesh | |
| 2021/0010663 | A1 | 1/2021 | Nikooyan | |
| 2021/0033268 | A1 | 2/2021 | Danesh | |
| 2021/0041070 | A1 | 2/2021 | Danesh | |
| 2021/0071836 | A1 | 3/2021 | Danesh | |
| 2021/0080084 | A1 | 3/2021 | Danesh | |
| 2021/0262650 | A1 | 8/2021 | Danesh | |

FOREIGN PATENT DOCUMENTS

| | | | |
|---|---|---|---|
| WO | WO2010051985 | A2 | 5/2010 |
| WO | WO 2018237294 | A2 | 12/2018 |
| WO | WO2018237294 | A2 | 12/2018 |
| WO | WO2018237294 | A3 | 12/2018 |
| WO | WO2019046310 | A1 | 3/2019 |
| WO | WO2019133669 | A1 | 7/2019 |
| WO | WO2019222259 | A1 | 11/2019 |
| WO | WO2019241198 | A1 | 12/2019 |
| WO | WO2021051101 | A1 | 3/2021 |

OTHER PUBLICATIONS

US 10,969,069 B2, 04/2021, Danesh (withdrawn)

ELCO E247 Product Publicly available at least as early as Sep. 6, 2018 See attached concurrently filed NPL document with two product images of this ELCO E247 Product.

SORAA LED Optical Light Engine See: https://res.cloudinary.com/soraa/image/upload/v1516986148/resources/misc/ole-more-info-pdf.pdf.

IMTRA Tide PowerLED Light Fixture See: https://www.imtra.com/1806fa8d-4593-40f4-bbf0-f9a833e92148/lighting-light-fixtures-detail.htm Publicly available at least as early as 2012.

ELCO 4" Round LED Reflector Insert Publicly available at least as early as Mar. 23, 2021 Website: https://elcolighting.com/products/4-round-led-reflector-insert.

(56) References Cited

OTHER PUBLICATIONS

ELCO 4" Five-Color Temperature Switch LED Reflector Inserts Publicly available at least as early as Mar. 23, 2021 Website: https://elcolighting.com/node/1432026.
MaxLite Publicly available at least as early as Mar. 23, 2021 Website: https://www.maxlite.com/news-and-events/2021/02/05/maxlite-introduces-canless-commercial-downlights-with-field-selectable-wattages-and-ccts/ And https://www.maxlite.com/products/universal-downlights-wattage-color-selectable/.
SORAA Vivid MR16—GU10; https://www.soraa.com/products/19-MR16-GU10.php (last visited Nov. 9, 2021).
DMF DRD2 Product Publicly available at least as early as Sep. 6, 2018 Website: https://www.dmflighting.com/product/drd2/.
DMF DRD4 Product Publicly available at least as early as Sep. 6, 2018 Website: https://www.dmflighting.com/product/drd4/.
Maxlite Publicly available at least as early as Mar. 23, 2021 Website: https://www.maxlite.com/news-and-events/2021/02/05/maxlite-introduces-canless-commercial-downlights-with-field-selectable-wattages-and-ccts/ And https://www.maxlite.com/products/universal-downlights-wattage-colox-selectable/.

* cited by examiner

DOWNLIGHT MODULE WITH EXTENDABLE LENS

TECHNICAL FIELD OF THE INVENTION

The present invention relates in general to downlights (e.g., for mounting in a given ceiling) and more specifically to downlight modules with extendable/retractable lens.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently (circa 2021) there are not LED (light emitting diode) downlight modules for installment into a given ceiling, using one or more of a trim, a can, a frame, and/or hanger bars, wherein after that installation, a shape of the cone of light emitted from that installed downlight module may be easily and/or readily changed, such that the cone of light is made narrower or broader.

There is a need in the art for a LED downlight module with an extendable lens, that is configured for installation into a given ceiling, using one or more of a trim, a can, a frame, and/or hanger bars, wherein after that installation, a shape of the cone of light emitted from that installed LED downlight module with the extendable lens may be easily and/or readily changed (e.g., by a simple twisting motion and/or a by simple pushing or pulling motions), such that the emitted cone of light is made narrower or broader.

It is to these ends that the present invention has been developed.

BRIEF SUMMARY OF THE INVENTION

To minimize the limitations in the prior art, and to minimize other limitations that will be apparent upon reading and understanding the present specification, various embodiments of the present invention describe a downlight module with an extendable lens. In some embodiments, the downlight module with the extendable lens may comprise: a heat sink module, a top (inner) cylinder, a bottom (outer) telescopic cylinder, a telescopic holder, a fixed lens, and the extendable lens. In some embodiments, the top (inner) cylinder may be attached to a bottom-portion of the heat sink module. In some embodiments, the bottom (outer) telescopic cylinder may be operatively linked to the top (inner) cylinder, such that the bottom (outer) telescopic cylinder may be movable up or down, which in turn, may retract or extend the extendable lens. In some embodiments, the fixed lens may be fixedly positioned within an internal cavity of the bottom-portion of the heat sink module. In some embodiments, the extendable lens may be located within the bottom (outer) telescopic cylinder that may be translatable in the up or the down direction. In some embodiments, the telescopic holder may function as exterior sleeve that may fixedly attach to an exterior of the bottom-portion and that may cover (exteriorly hide) all of the fixed lens and the top (inner) cylinder. In some embodiments, the bottom (outer) telescopic cylinder (with the telescopic lens) may be move in the up or the down direction via a twisting motion and/or a linear sliding motion of the bottom (outer) telescopic cylinder (with respect to the top (inner) cylinder). In some embodiments, extension or retraction of the bottom (outer) telescopic cylinder (with the telescopic lens) may be in a direction that is substantially parallel with an overall/common axial (longitudinal) centerline of the downlight module with the extendable lens in its assembled configuration. In some embodiments, the bottom (outer) telescopic cylinder may extend beyond a bottom axial terminal end of the telescopic holder.

In some embodiments, the downlight module with the extendable lens may further comprise one or more of: at least one LED light source (e.g., a LED chip), a LED chip holder, a mounting plate, an electric power cable, an electrical power connector, portions thereof, combinations thereof, and/or the like.

In some embodiments, a light system may comprise at least one downlight module with the extendable lens and one or more of: a driver cap, a trim, a can, a frame, hanger bars, portions thereof, combinations thereof, and/or the like.

It is an objective of the present invention to provide a downlight module with an extendable lens.

It is another objective of the present invention to provide the downlight module with the extendable lens that may be installed within a given ceiling.

It is another objective of the present invention to provide the downlight module with the extendable lens, such extension or retraction of the extendable lens may be readily performed before or after the downlight module with the extendable lens may be installed within the given ceiling.

It is another objective of the present invention to provide the downlight module with the extendable lens, such that extension or retraction of the extendable lens may change a diameter, width, broadness, and/or narrowness of a cone of light emitted from below that given downlight module with the extendable lens.

It is another objective of the present invention to provide the downlight module with the extendable lens, such extension or retraction of the extendable lens may be readily performed by twisting the bottom (outer) telescopic cylinder.

It is another objective of the present invention to provide the downlight module with the extendable lens, such extension or retraction of the extendable lens may be readily performed by pushing in or pulling out the bottom (outer) telescopic cylinder.

It is yet another objective of the present invention to provide the downlight module with the extendable lens, that may be readily attached to one or more of: a driver cap, a trim, a can, a frame, hanger bars, portions thereof, combinations thereof, and/or the like.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1F includes sectional line 2C-2C, see FIG. 2C for the cross-sectional view from this sectional line.

REFERENCE NUMERAL SCHEDULE

Figure 1A:
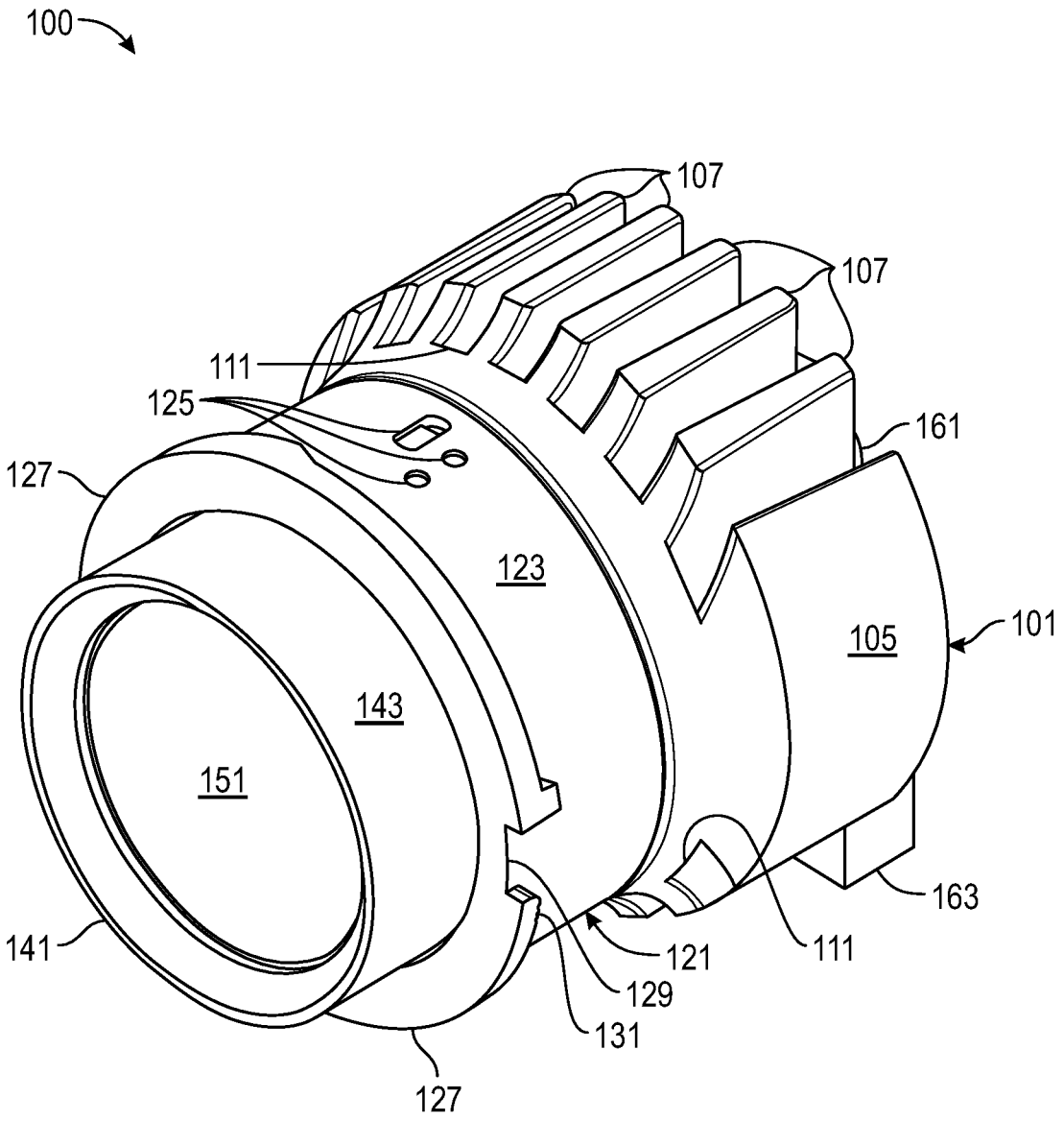
FIG. 1A depicts a bottom perspective view of a downlight module with extendable lens, in an assembled configuration.

100 downlight module with extendable lens 100
101 heat sink module 101
103 top-portion 103
105 side-wall 105
107 fin(s) 107
109 top 109
111 recessed-space (between fins) 111
113 hole 113
115 protrusion 115
117 enclosed-pocket 117
121 telescopic holder 121
123 side-wall 123
125 hole 125
127 flange 127
129 notch 129
131 teeth 131
141 bottom (outer) telescopic cylinder 141
143 side-wall 143
151 telescopic lens (second lens) (bottom lens) 151
161 electric power cable 161
163 electrical power connector 163
201 bottom-portion 201 (of heat sink module 101)
203 internal cavity 203
205 annular ring 205
211 LED chip 211
213 LED chip holder 213
215 mounting plate (elevated) 215
221 lens (fixed lens) 221
231 top (inner) cylinder 231
233 top flange 233
235 annular ring 235
241 fastener(s) 241
245 lens-interaction 245
299 axial (longitudinal) centerline 299
301 minimum extension 301
303 maximum extension 303
400 assembly 400
401 driver cap 401
411 trim 411
500 assembly 500
501 can 501
503 frame 503
505 hanger bars 505

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1A depicts a bottom perspective view of a downlight module with extendable lens 100, in an assembled configuration. In some embodiments, downlight module with extendable lens 100 may be located within a given ceiling and configured to shine light downwards from that ceiling. In some embodiments, downlight module with extendable lens 100 may be installed within a trim and can, mounted in and/or behind the given ceiling. In some embodiments, downlight module with extendable lens 100 may have a telescopic lens 151 that may be extended and/or retracted predetermined distance(s) so the cone of light emitted from downlight module with extendable lens 100 may be wider or narrower. In some embodiments, telescopic lens 151 may be extended or retracted by rotating bottom (outer) telescopic cylinder 141.

In some embodiments, downlight module with extendable lens 100 may comprise one or more light sources. In some embodiments, the one or more light sources of downlight module with extendable lens 100 may be one or more LEDs, wherein "LED" herein may refer to at least one light emitting diode. In some embodiments, the one or more light sources may be other types light sources besides LED(s). In some embodiments, the one or more light sources may emit light of predetermined color(s), predetermined temperature (e.g., in Kelvin), of predetermined wavelength, portions thereof, combinations thereof, and/or the like.

In some embodiments, with respect to downlight module with extendable lens 100, and with further respect to location and/or directional indicators used herein, such as, but not limited to, top, bottom, up, down, above, below, higher, and/or lower, may be with respect to a given downlight module with extendable lens 100 being installed in a ceiling vertically above a ground, such that bottom, down, below, and lower may be associated with that ground or moving/pointing towards that ground; and top, up, above, and higher may be associated with moving/pointing towards that ceiling or vertically past that ceiling. In some embodiments, with respect to downlight module with extendable lens 100, and with further respect to location and/or directional indicators used herein, such as, but not limited to, top, bottom, up, down, above, below, higher, and/or lower, may be with respect to a vertical direction; and that vertical direction may be substantially (mostly) parallel with a local gravitational vector of where a given downlight module with extendable lens 100 may be installed in a given ceiling. In some embodiments, the down direction (and/or the like) may be from top 109 towards telescopic lens 151; whereas, the up direction (and/or the like) may be from telescopic lens 151 to top 109.

Continuing discussing FIG. 1A, in some embodiments, downlight module with extendable lens 100 may comprise: heat sink module 101, telescopic holder 121, bottom (outer) telescopic cylinder 141, and telescopic lens 151. In some embodiments, a bottom-portion 201 of heat sink module 101 may be inserted into and/or attached to telescopic holder 121. In some embodiments, a bottom-portion 201 of heat sink module 101 may be inserted into and/or attached to a top (inner) cylinder 231. Note, see FIG. 2A for bottom-portion 201 and top (inner) cylinder 231. Continuing discussing FIG. 1A, in some embodiments, top (inner) cylinder 231 may be inserted into and/or attached to bottom (outer) telescopic cylinder 141. In some embodiments, telescopic lens 151 may be located (disposed) within bottom (outer) telescopic cylinder 141. In some embodiments, telescopic lens 151 may be fixedly attached within bottom (bottom) telescopic cylinder 141 at or towards a bottom axial terminal end of bottom (outer) telescopic cylinder 141. In some embodiments, bottom portions of bottom (outer) telescopic cylinder 141 may extend or retract through a main central opening of telescopic holder 121.

Continuing discussing FIG. 1A, in some embodiments, heat sink module 101 may house various circuits, electronics, electrical components, wires, cables, LED chip 211, LED chip holder 213, mounting plate (elevated) 215, fixed (second and/or internal) lens 221, portions thereof, combinations thereof, and/or the like of downlight module with extendable lens 100. In some embodiments, the heat sink module 101 itself may comprise a top-portion 103 and the bottom-portion 201. In some embodiments, aspects of the top-portion 103 may be visible in FIG. 1A through FIG. 3B; whereas, bottom-portion 201 may be shown in FIG. 2A. That is, when downlight module with extendable lens 100 may be in its assembled configuration, bottom-portion 201 may not be readily visible from an exterior of downlight module with extendable lens 100. In some embodiments, top-portion 103 and bottom-portion 201 may be integral, such that heat sink module 101 may be one integral part/component. In some embodiments, top-portion 103 may flow/transition mostly (substantially) seamlessly/smoothly into bottom-portion 201. In some embodiments, heat sink module 101 may be cast, injection molded, and/or 3D (three dimensional) printed.

Continuing discussing FIG. 1A, in some embodiments, top-portion 103 may be a mostly (substantially) cylindrical member, of a circumferential rounded/curved side-wall 105. In some embodiments, the side-wall 105 may be interrupted by a plurality of linear running fins 107. In some embodiments, the plurality of fins 107 may be configured to conduct and transmit heat from electronics associated with heat sink module 101 away from heat sink module 101. In some embodiments, the plurality of fins 107 may be heat dissipation fins. In some embodiments, each pair of adjacent fins 107 may be spaced apart by recessed-space 111.

Continuing discussing FIG. 1A, in some embodiments, telescopic holder 121 may be attached to and/or in communication with bottom-portion 201 of heat sink module 101. In some embodiments, telescopic holder 121 may be a hollow cylindrical member. In some embodiments, a main hollow interior of telescopic holder 121 may receive portions/regions of bottom-portion 201 and/or of bottom (outer) telescopic cylinder 141. In some embodiments, with respect to a height (length) of telescopic holder 121 that may be parallel to axial (longitudinal) centerline 299, most of that height (length) may be side-wall 123 of telescopic holder 121 and a minority of that height (length) may be of a mostly (substantially) annular flange 127. In some embodiments, side-wall 123 may be a side-wall of telescopic holder 121. In some embodiments, flange 127 may be a mostly (substantially) annular flange of telescopic holder 121. In some embodiments, flange 127 may be a bottom flange 127, i.e., a flange 127 located at a bottom axial terminal end of telescopic holder 121. In some embodiments, side-wall 123 may be mostly (substantially) cylindrical. In some embodiments, side-wall 123 may have a uniform, fixed, constant, and/or non-variable diameter (inner and outer). In some embodiments, an outer diameter of side-wall 143 (of bottom [outer] telescopic cylinder 141) may fit within an inner diameter of side-wall 123. In some embodiments, an outer diameter of bottom-portion 201 (of heat sink module 101) may fit within an inner diameter of side-wall 123. In some embodiments, side-wall 123 may comprise at least one hole 125. In some embodiments, hole 125 may be a through hole through a portion of side-wall 123. In some embodiments, hole 125 may be configured to receive a set screw and/or a portion of a wire. In some embodiments, side-wall 123 may flow/transition smoothly, cleanly, and/or seamlessly into flange 127. In some embodiments, side-wall 123 and flange 127 may be integral, such that telescopic holder 121 may be a single part/component. In some embodiments, flange 127 may have at least one interruption, in a form of at least one notch 129. In some embodiments, notch 129 may be a notch in flange 127. In some embodiments, flange 127 may have two notches 129. In some embodiments, flange 127 may have two opposing notches 129. In some embodiments, adjacent to notch 129 may be teeth 131 (see e.g., FIG. 1D for teeth 131). In some embodiments, flange 127, notch 129, and/or teeth 131 may be configured for attachment to complimentary structures of a given trim 411 and/or a given can 501. In some embodiments, telescopic holder 121 may comprise a bottom flange 127, notch 129, and/or teeth 131 that may be configured to be attached to trim 411 and/or can 501.

Continuing discussing FIG. 1A, in some embodiments, bottom (outer) telescopic cylinder 141 may be mostly (substantially) hollow cylindrical member. In some embodiments, bottom (outer) telescopic cylinder 141 may comprise side-wall 143. In some embodiments, side-wall 143 may be a side-wall of bottom (outer) telescopic cylinder 141. In some embodiments, an outside diameter of side-wall 143 may fit within an inside diameter of telescopic holder 121. In some embodiments, at least some portions/regions of side-wall 143 may extend or retract through the inside diameter of telescopic holder 121. In some embodiments, telescopic lens 151 may be fixedly attached at or near/proximate (e.g., within one inch) to a bottom axial terminal end of bottom (outer) telescopic cylinder 141. In some embodiments, telescopic lens 151 may be attached within bottom (outer) telescopic cylinder 141. In some embodiments, portions of top (inner) cylinder 231 may be received within bottom (outer) telescopic cylinder 141. In some embodiments, portions of top (inner) telescopic cylinder 231 may be received within and attached to bottom (outer) telescopic cylinder 141, such that some rotational movement between bottom (outer) telescopic cylinder 141 and top (inner) cylinder 231 may be permitted, within a predetermined range of rotational motion. In some embodiments, an inside diameter of bottom (outer) telescopic cylinder 141 may comprise threading that may be complimentary to threading on an outside diameter of top (inner) cylinder 231. In some embodiments, the inside diameter of bottom (outer) telescopic cylinder 141 may be threadedly attached to the outside diameter of top (inner) cylinder 231. In some embodiments, bottom (outer) telescopic cylinder 141 (via rotational threaded coupling to top (inner) cylinder 231) may extend or retract with respect to heat sink module 101, telescopic holder 121, top (inner) cylinder 231, lens 221, LED chip 211, LED chip holder 213, mounting plate 215, portions thereof, combinations thereof, and/or the like.

Continuing discussing FIG. 1A, in some embodiments, telescopic lens 151 may be one of two different lens of downlight module with extendable lens 100. In some embodiments, telescopic lens 151 may also be referred to as extendable lens 151, bottom lens 151, and/or first lens 151; whereas, lens 221 may be referred to as fixed lens 221, as second lens 221, and/or top lens 221. In some embodiments, telescopic lens 151 may be fixedly associated with a bottom axial terminal end of bottom (outer) telescopic cylinder 141. In some embodiments, telescopic lens 151 may be fixedly located within bottom (outer) telescopic cylinder 141 at or near/proximate (e.g., within one inch) to the bottom axial terminal end of bottom (outer) telescopic cylinder 141. In some embodiments, telescopic lens 151 may be fixedly attached to and within bottom (outer) telescopic cylinder 141 at or near/proximate (e.g., within one inch) to the bottom axial terminal end of bottom (outer) telescopic cylinder 141. In some embodiments, telescopic lens 151 may be extendable or retractable (via rotation of bottom [outer] telescopic cylinder 141) with respect to heat sink module 101, telescopic holder 121, top (inner) cylinder 231, lens 221, LED chip 211, LED chip holder 213, mounting plate 215, portions thereof, combinations thereof, and/or the like. In some embodiments, telescopic lens 151 may be convex, concave, with a bottom that is convex, or with a bottom that is concave. In some embodiments, telescopic lens 151 may have a bottom that is convex.

Continuing discussing FIG. 1A, a portion of an electrical power connector 163 may also be visible in FIG. 1A. In some embodiments, electrical power connector 163 may be a connector for making electrical connections. In some embodiments, electrical power connector 163 may have a shape and characteristics for making an industry, standardized, and/or regulatory required electrical connection with a given electrical power source.

Figure 1B:
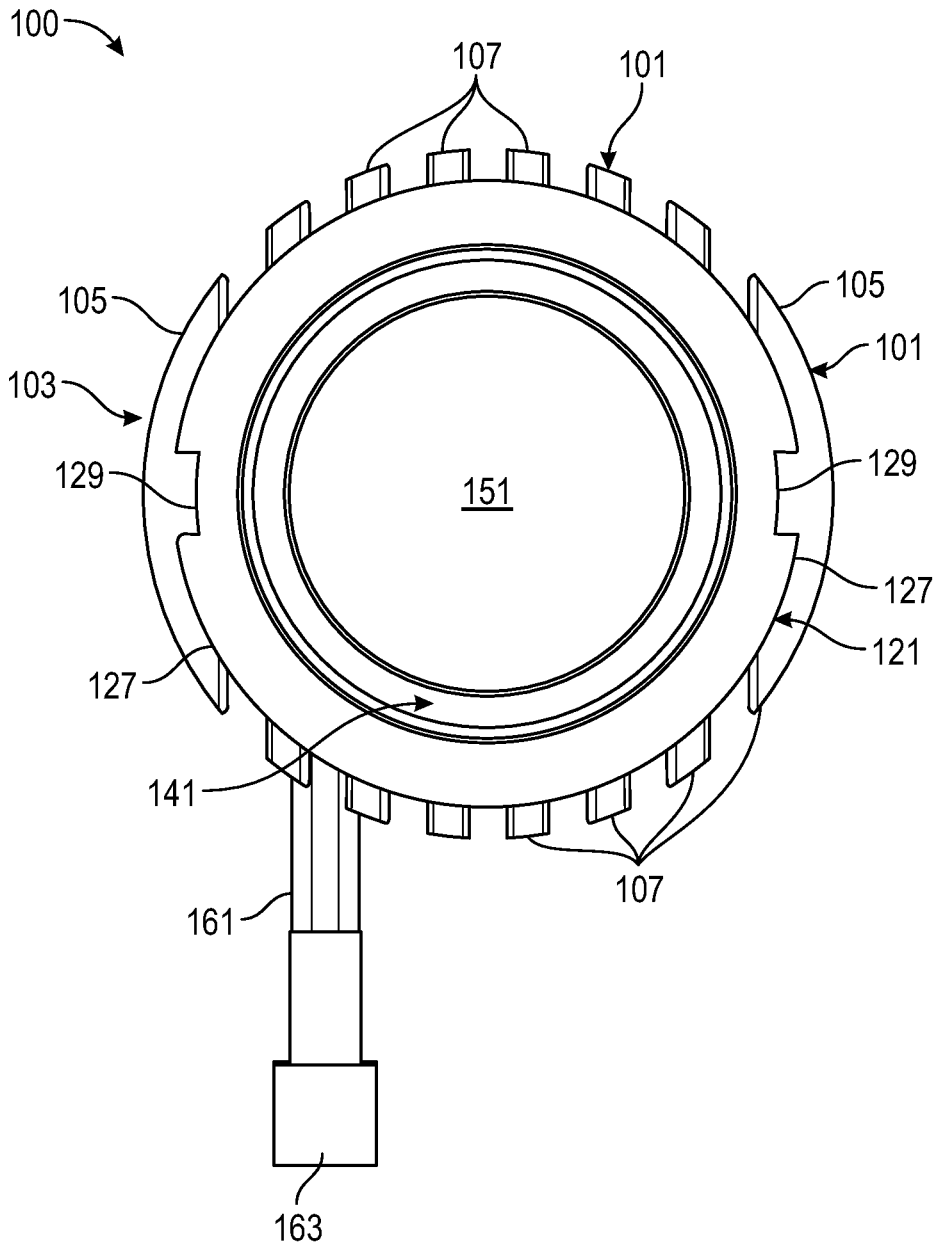
FIG. 1B depicts a bottom view of the downlight module with extendable lens of FIG. 1A, in an assembled configuration.

FIG. 1B depicts a bottom view of downlight module with extendable lens 100, in an assembled configuration. In some embodiments, bottom surfaces of flange 127, bottom (outer) telescopic cylinder 141, and telescopic lens 151 may be seen in FIG. 1B. In some embodiments, flange 127 may comprise opposing notches 129. In some embodiments, a given notch 129 may be below side-wall 105 of top-portion 103. Additionally in FIG. 1B, some bottom portions of top-portion 103 and fins 107 may be seen. In some embodiments, electrical power connector 163 may be attached to electric power cable 161. In some embodiments, electric power cable 161 may comprise one or more insulated electrically conductive wires. In some embodiments, electric power cable 161 may be configured to convey/transmit electrical power.

Figure 1C:
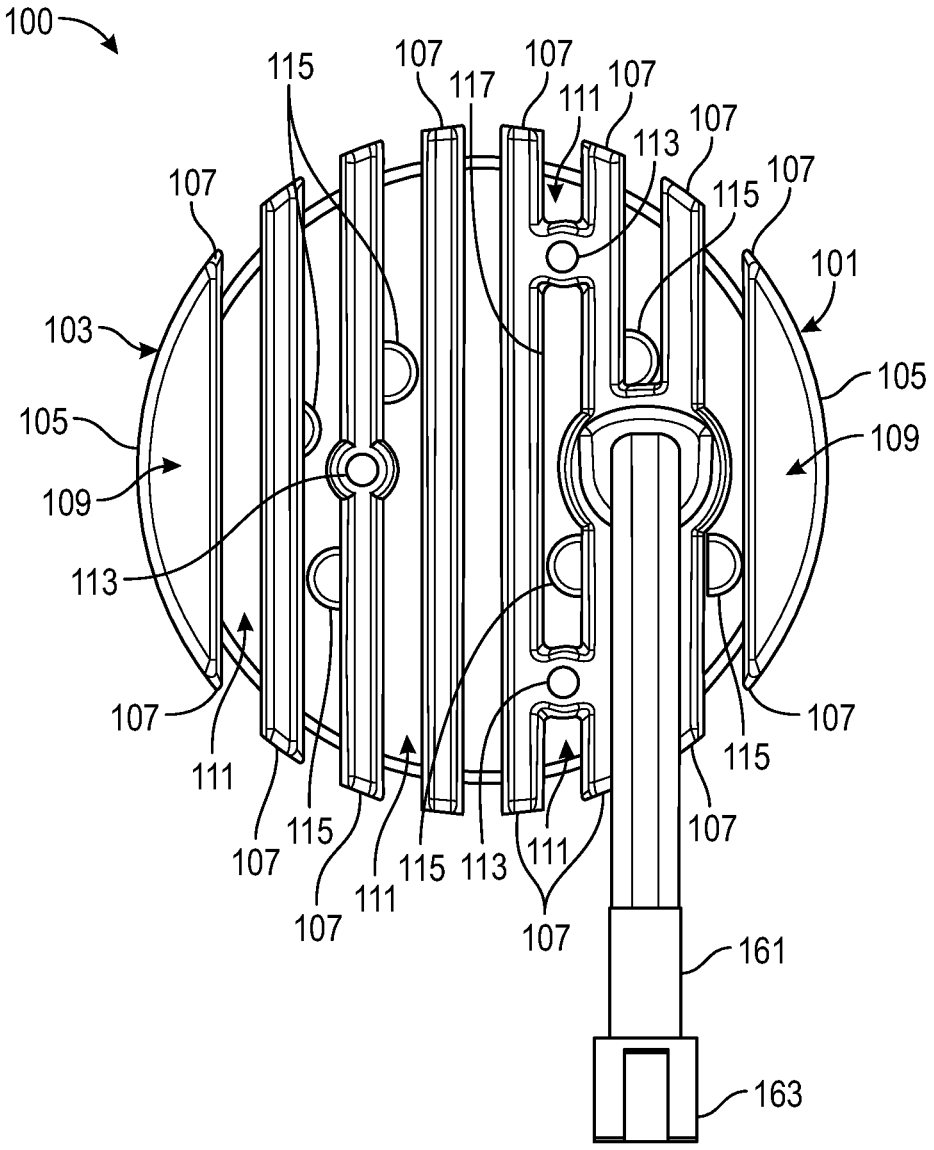
FIG. 1C depicts a top view of the downlight module with extendable lens of FIG. 1A, in an assembled configuration.

FIG. 1C depicts a top view of downlight module with extendable lens 100, in an assembled configuration. In some embodiments, FIG. 1C may be an opposing view as compared to FIG. 1B. In FIG. 1C most of top 109 of heat sink module 101 may be seen, except some portions of top 109 obscured by portions of electric power cable 161. In some embodiments, heat sink module 101 may comprise top 109. In some embodiments, top 109 may be top/upper surface(s) of heat sink module 101. For example, and without limiting the scope of the present invention, tops 109 of most fins 107 may be seen in FIG. 1C.

Continuing discussing FIG. 1C, in some embodiments, top-portion 103 may comprise eight (8) fins 107. In some embodiments, those eight (8) fins 107 may have fixed but different (variable) lengths, wherein fins 107 lengths may be substantially perpendicular (orthogonal) to axial (longitudinal) centerline 299. In some embodiments, the inner most fins 107 may have the longest fin 107 length. In some embodiments, the outer most fins 107 may have the shortest find 107 length. In some embodiments, the six (6) inner of those eight (8) fins 107 may run in substantially a same linearly straight direction that may be substantially perpendicular (orthogonal) to axial (longitudinal) centerline 299; whereas, outsides of the two (2) outermost fins 107 of those eight (8) fins 107 may be curved, but the interior sides of the two (2) outermost fins 107 may still run in substantially the same linearly straight direction as the other six (6) fins 107. In some embodiments, the six (6) inner of those eight (8) fins 107 may have a substantially same fin 107 thickness, wherein fin 107 thickness may be substantially perpendicular (orthogonal) to axial (longitudinal) centerline 299 and substantially perpendicular to fin 107 length. In some embodiments, the outer two (2) fins 107 may have a same fin 107 thickness as each other, that may be different from the fins 107 thickness of the six (6) inner fins 107. In some embodiments, recessed-spaces 111 between adjacent fins 107 may be readily visible in FIG. 1C. In some embodiments, each recessed-space 111 may be substantially a same distance/dimension. In some embodiments, there may be seven (7) recessed-spaces 111.

Continuing discussing FIG. 1C, in some embodiments, top 109 may comprise at least one hole 113. In some embodiments, at least fin 107 may comprise at least one hole 113. In some embodiments, hole 113 may be a hole that may be substantially parallel with axial (longitudinal) centerline 299. In some embodiments, hole 113 may be configured to receive a fastener 241 and/or a portion of a wire/cable. In some embodiments, top 109 may comprise three holes 113. In some embodiments, top 109 and/or fin(s) 107 may comprise a predetermined quantity of hole(s) 113.

Continuing discussing FIG. 1C, in some embodiments, protrusion(s) 115 may extend at least partially into a given recessed-space 111 (from a direction of bottom-portion 201). In some embodiments, protrusion 115 may have a height, that may be substantially parallel with axial (longitudinal) centerline 299 (see e.g., FIG. 1F and/or FIG. 1G). In some embodiments, fins 107 may have a height, that may be substantially parallel with axial (longitudinal) centerline 299 (see e.g., FIG. 1F and/or FIG. 1G). In some embodiments, the height of protrusion 115 may be less than the height of fins 107 (see e.g., FIG. 1F and/or FIG. 1G).

Continuing discussing FIG. 1C, in some embodiments, two adjacent fins 107 may be define and confine an enclosed-pocket 117. In some embodiments, enclosed-pocket 117 may be substantially rectangular in shape when viewed from FIG. 1C. In some embodiments, enclosed-pocket 117 may be mostly of void space. In some embodiments, opposing ends of enclosed-pocket 117 may be bound with two opposing holes 113. In some embodiments, there may be at least one protrusion 115 within enclosed-pocket 117. In some embodiments, a length of enclosed-pocket 117 may be less than an outside diameter of top-portion 103; wherein the length of enclosed-pocket 117 may be substantially perpendicular (orthogonal) to axial (longitudinal) centerline 299.

Continuing discussing FIG. 1C, in some embodiments, electric power cable 161 may run into heat sink module 101. In some embodiments, electric power cable 161 may be attached to heat sink module 101 at one axial terminal end of electric power cable 161 and to electrical power connector 163 at an opposing axial terminal end of electric power cable 161. In some embodiments, electric power cable 161 may convey/transmit electrical power into heat sink module 101 for use by the electronics of downlight module with extendable lens 100. In some embodiments, electric power cable 161 may be flexible.

Figure 1D:
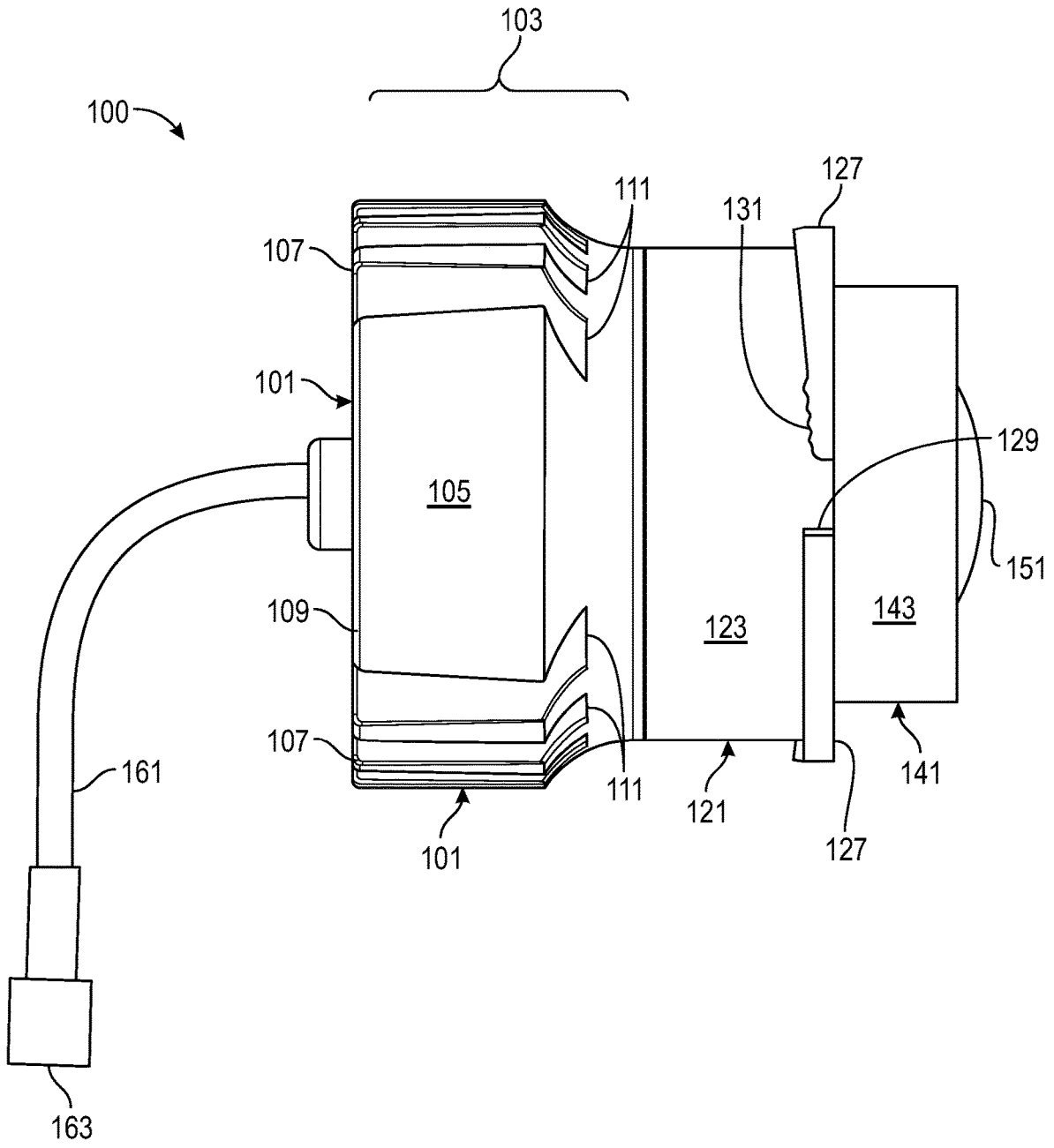
FIG. 1D depicts a left-side perspective view of the downlight module with extendable lens of FIG. 1A, in an assembled configuration.

FIG. 1D depicts a left-side perspective view of downlight module with extendable lens 100, in an assembled configuration. FIG. 1D may show teeth 131 on flange 127 adjacent to notch 129. FIG. 1D may show a center/middle portion of telescopic lens 151 that may project/extend past a bottom axial terminal end of bottom (outer) telescopic cylinder 141.

Figure 1E:
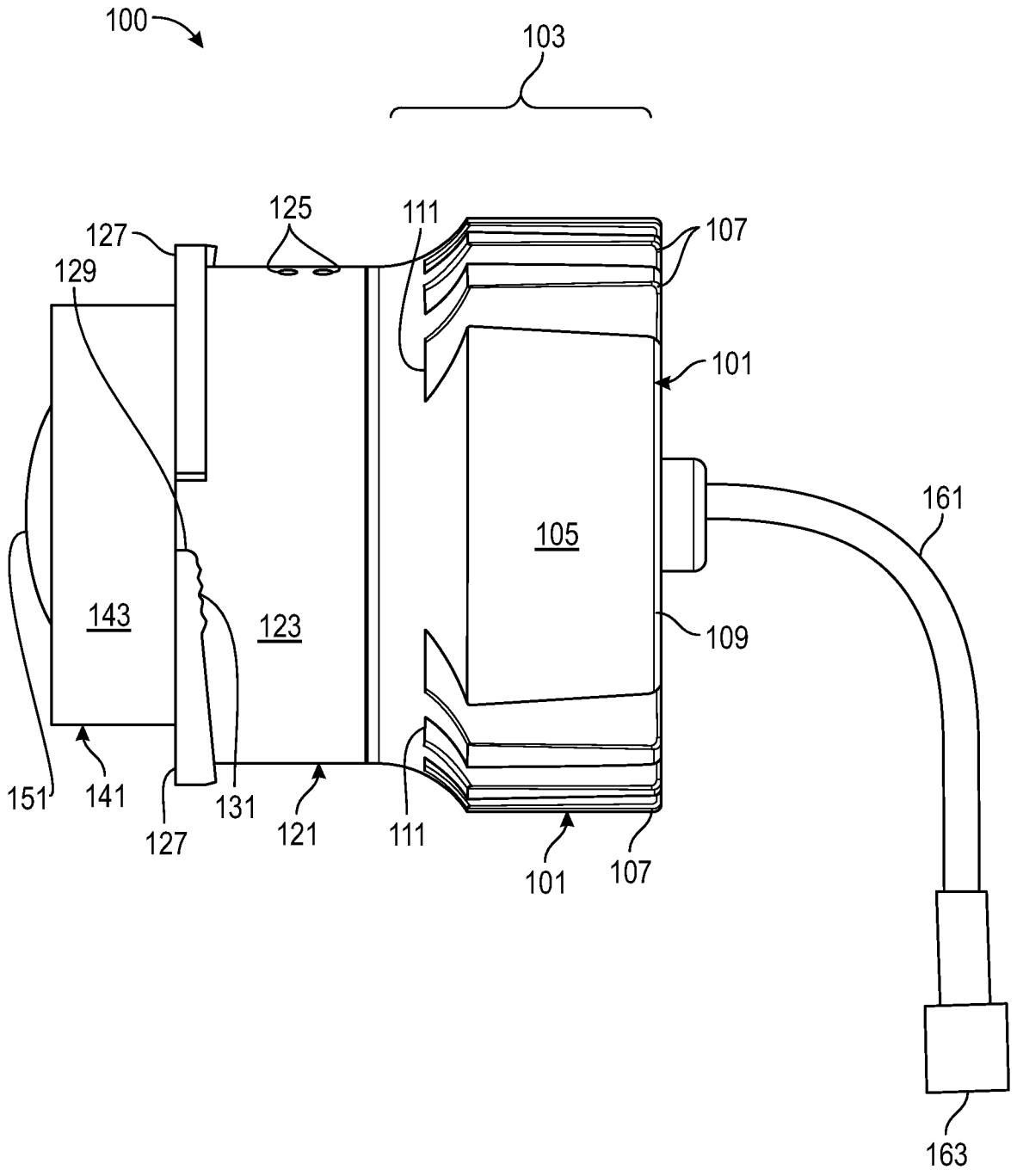
FIG. 1E depicts a right-side view of the downlight module with extendable lens of FIG. 1A, in an assembled configuration.

FIG. 1E depicts a right-side view of downlight module with extendable lens 100, in an assembled configuration. In some embodiments, FIG. 1E may be an opposing view as compared to FIG. 1D. FIG. 1E may show teeth 131 on flange 127 adjacent to notch 129. FIG. 1E may show a center/middle portion of telescopic lens 151 that may project/extend past a bottom axial terminal end of bottom (outer) telescopic cylinder 141. FIG. 1E may show portions of one or more holes 125 on side-wall 123 of telescopic holder 121. In some embodiments, at least one hole 125 may be spaced apart from at least one notch 129 by about ninety (90) degrees (plus or minus one (1) degree).

Figure 1F:
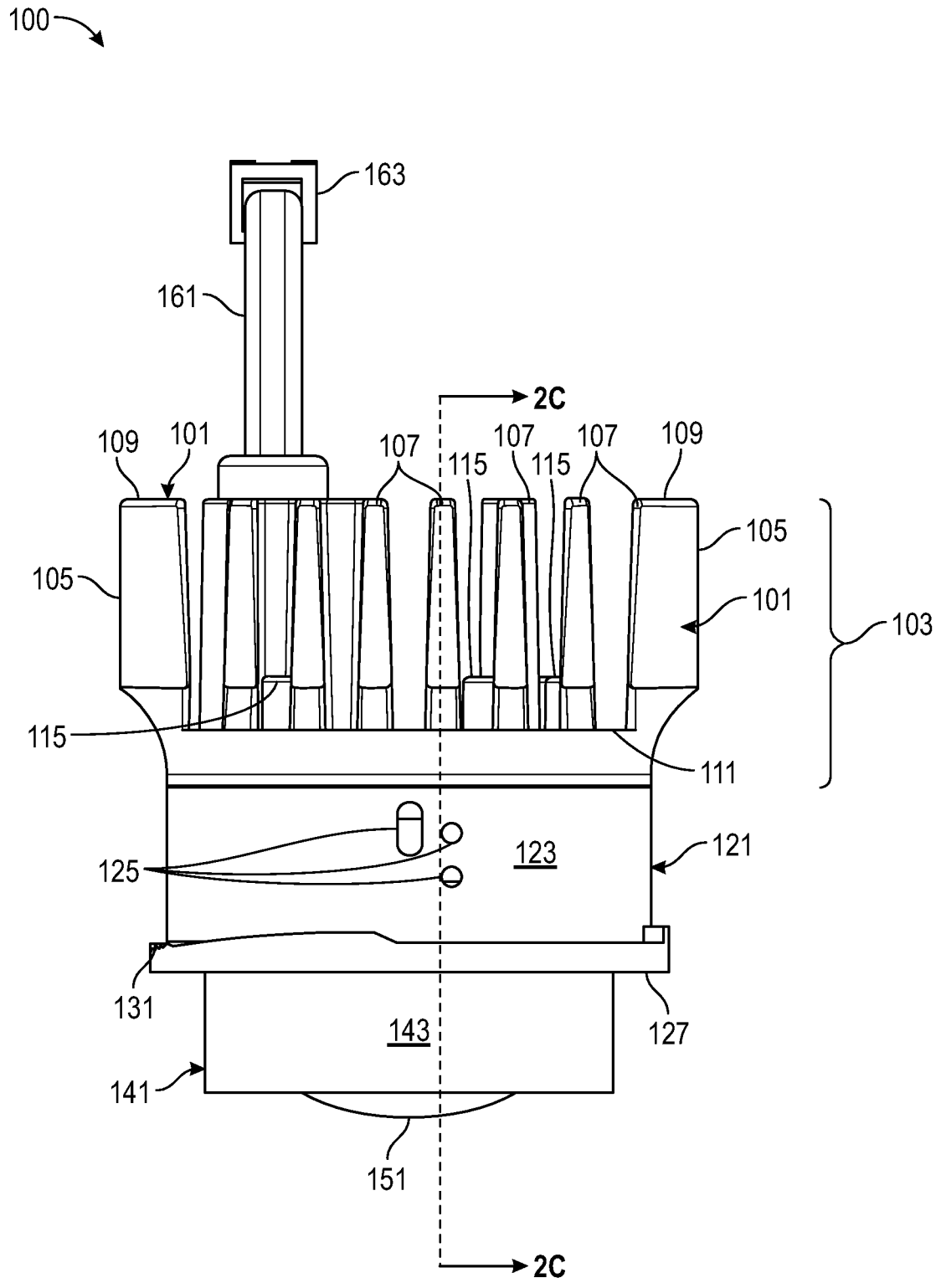
FIG. 1F depicts a front view of the downlight module with extendable lens of FIG. 1A, in an assembled configuration.

FIG. 1F depicts a front view of downlight module with extendable lens 100, in an assembled configuration. In some embodiments, at least one hole 125 may be located on side-wall 123 of telescopic holder 121. In some embodiments, at least one hole 125 may be located on a middle front of side-wall 123 of telescopic holder 121. In some embodiments, protrusion 115 may have a height, that may be substantially parallel with axial (longitudinal) centerline 299. In some embodiments, fins 107 may have a height, that may be substantially parallel with axial (longitudinal) centerline 299. In some embodiments, the height of protrusion 115 may be less than the height of fins 107. In some embodiments, all fins 107 may be of a same fixed, constant, finite, and non-variable height. In some embodiments, with respect to five (5) of the recessed-spaces 111, a line of sight from the front to a rear of downlight module with extendable lens 100 may be mostly (substantially) unobstructed; whereas, for two (2) of the recessed-spaces 111, the line of sight from the front to the rear of downlight module with extendable lens 100 may be entirely obstructed by holes 113 and/or by where electric power cable 161 attaches to heat sink module 101. FIG. 1F also includes sectional line 2C-2C, see FIG. 2C for the cross-sectional figure arising from sectional line 2C-2C.

Figure 1G:
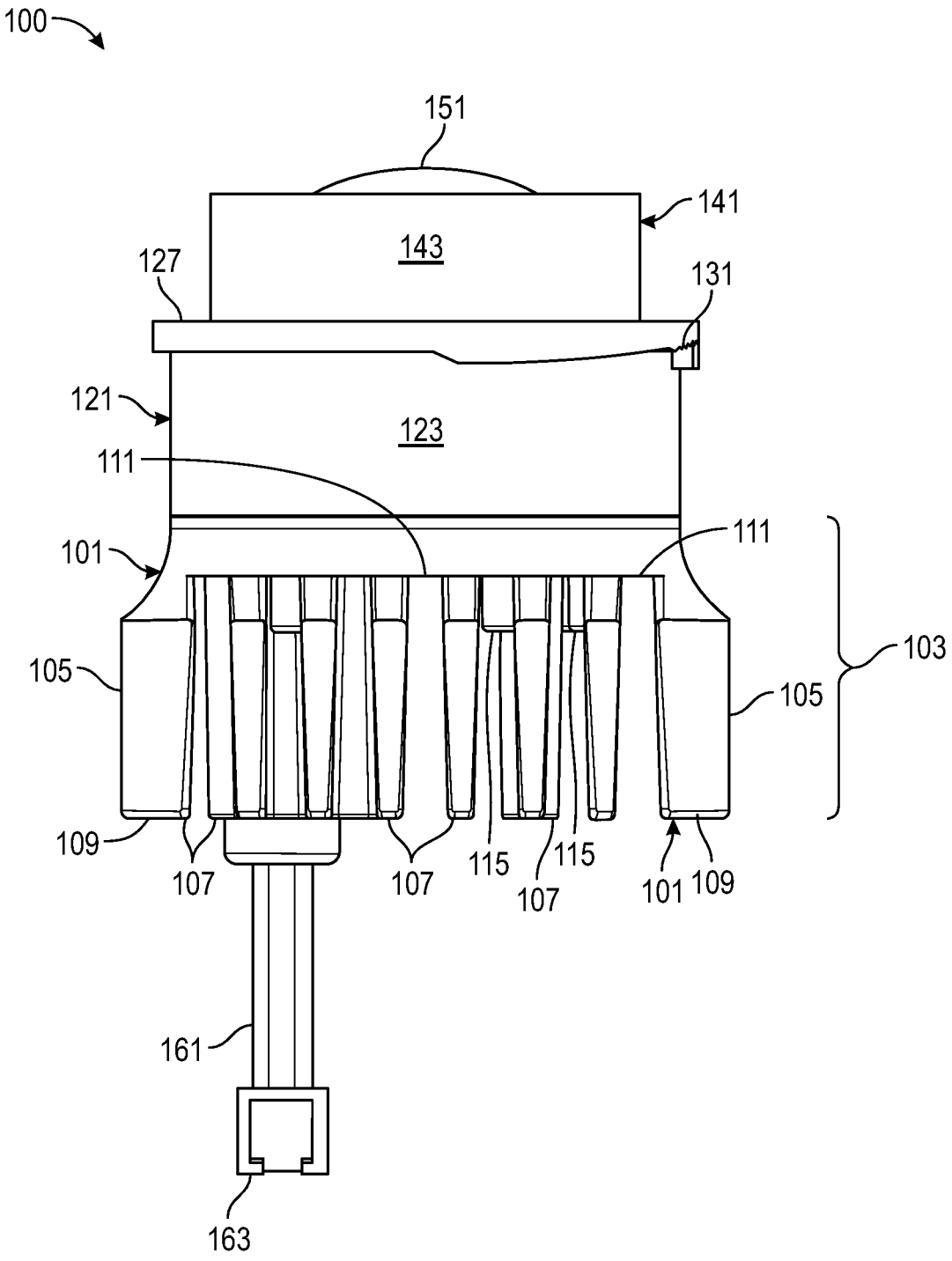
FIG. 1G depicts a rear (back) view of the downlight module with extendable lens of FIG. 1A, in an assembled configuration.

FIG. 1G depicts a rear (back) view of downlight module with extendable lens 100, in an assembled configuration. In some embodiments, FIG. 1G may be an opposing view as compared to FIG. 1F. In some embodiments, protrusion 115 may have a height, that may be substantially parallel with axial (longitudinal) centerline 299. In some embodiments, fins 107 may have a height, that may be substantially parallel with axial (longitudinal) centerline 299. In some embodiments, the height of protrusion 115 may be less than the height of fins 107. In some embodiments, all fins 107 may be of a same fixed, constant, finite, and non-variable height. In some embodiments, with respect to five (5) of the recessed-spaces 111, a line of sight from the front to the rear of downlight module with extendable lens 100 may be mostly (substantially) unobstructed; whereas, for two (2) of the recessed-spaces 111, the line of sight from the front to the rear of downlight module with extendable lens 100 may be entirely obstructed by holes 113 and/or by where electric power cable 161 attaches to (top 109 of) heat sink module 101.

Figure 1H:
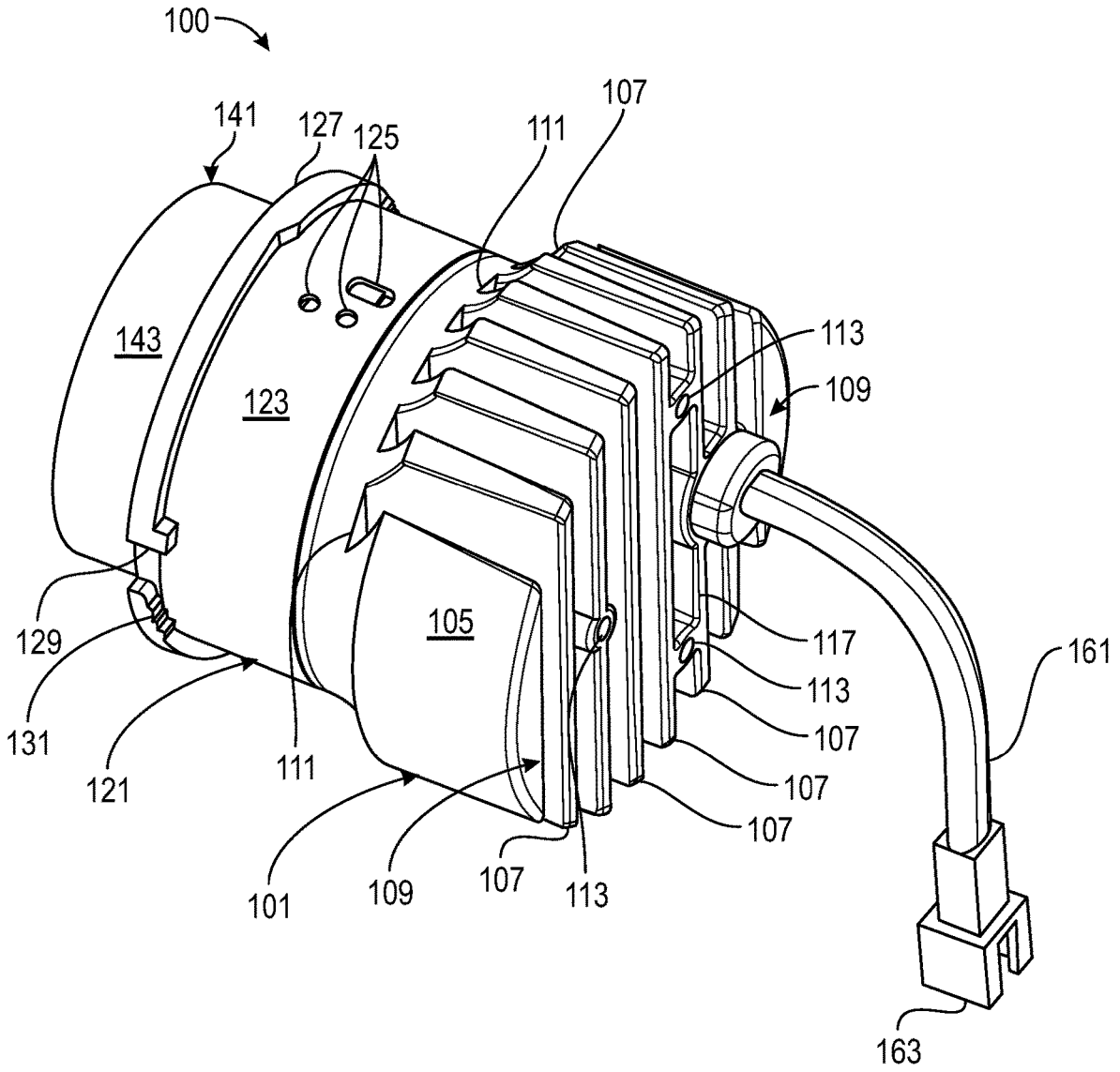
FIG. 1H depicts a top perspective view of the downlight module with extendable lens of FIG. 1A, in an assembled configuration.

FIG. 1H depicts a top perspective view of downlight module with extendable lens 100, in an assembled configuration. In FIG. 1H the following may be seen: exterior portions of side-wall 143 of bottom (outer) telescopic cylinder 141; exterior portions of flange 127 of telescopic holder 121; a notch 129 within flange 127; exterior portions of side-wall 123 of telescopic holder 121; hole(s) 125 on side-wall 123; portions of top-portion 103 of heat sink module 101; exterior portions of side-wall 105 of top-portion 103; portions of fins 107 of top-portion 103; portions of top 109 of top-portion 103; hole(s) 113 of top-portion 103; electric power cable 161; and electrical power connector 163.

Figure 2A:
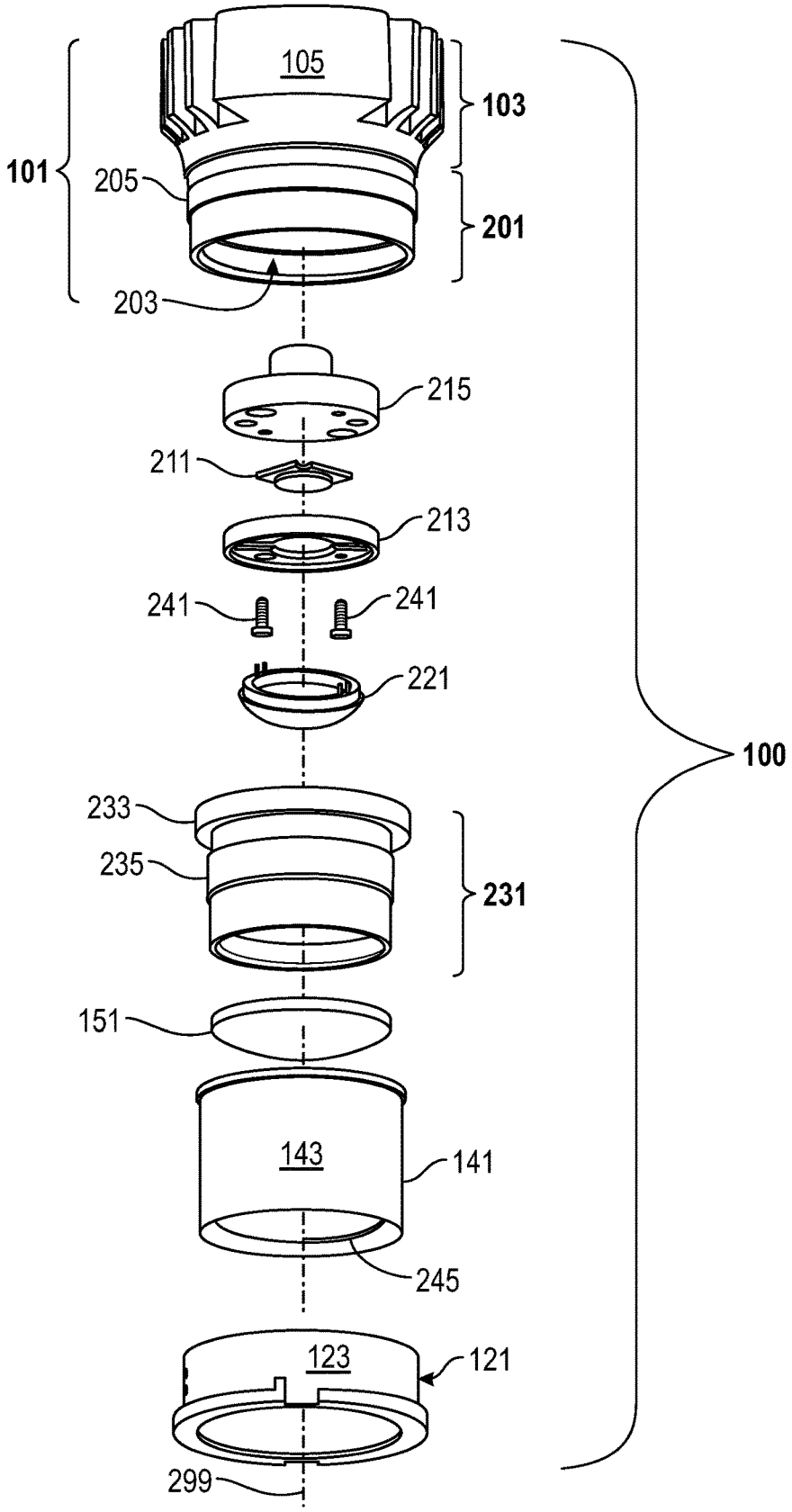
FIG. 2A depicts a bottom perspective exploded view of the downlight module with extendable lens of FIG. 1A, in an exploded configuration along an axial (longitudinal) centerline.
Figure 2B:
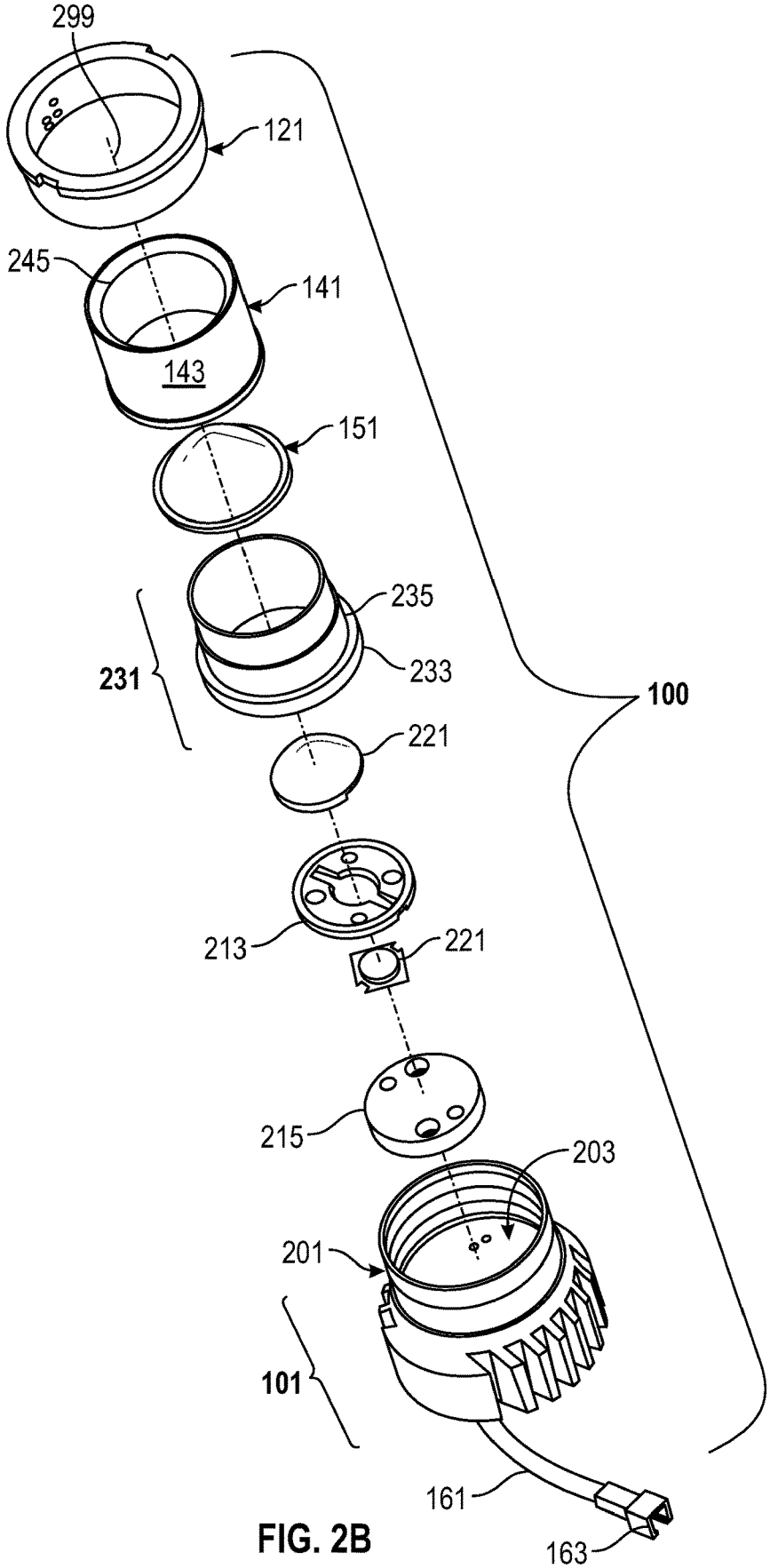
FIG. 2B depicts another bottom perspective exploded view of the downlight module with extendable lens of FIG. 1A, in an exploded configuration along the axial (longitudinal) centerline.
Figure 2C:
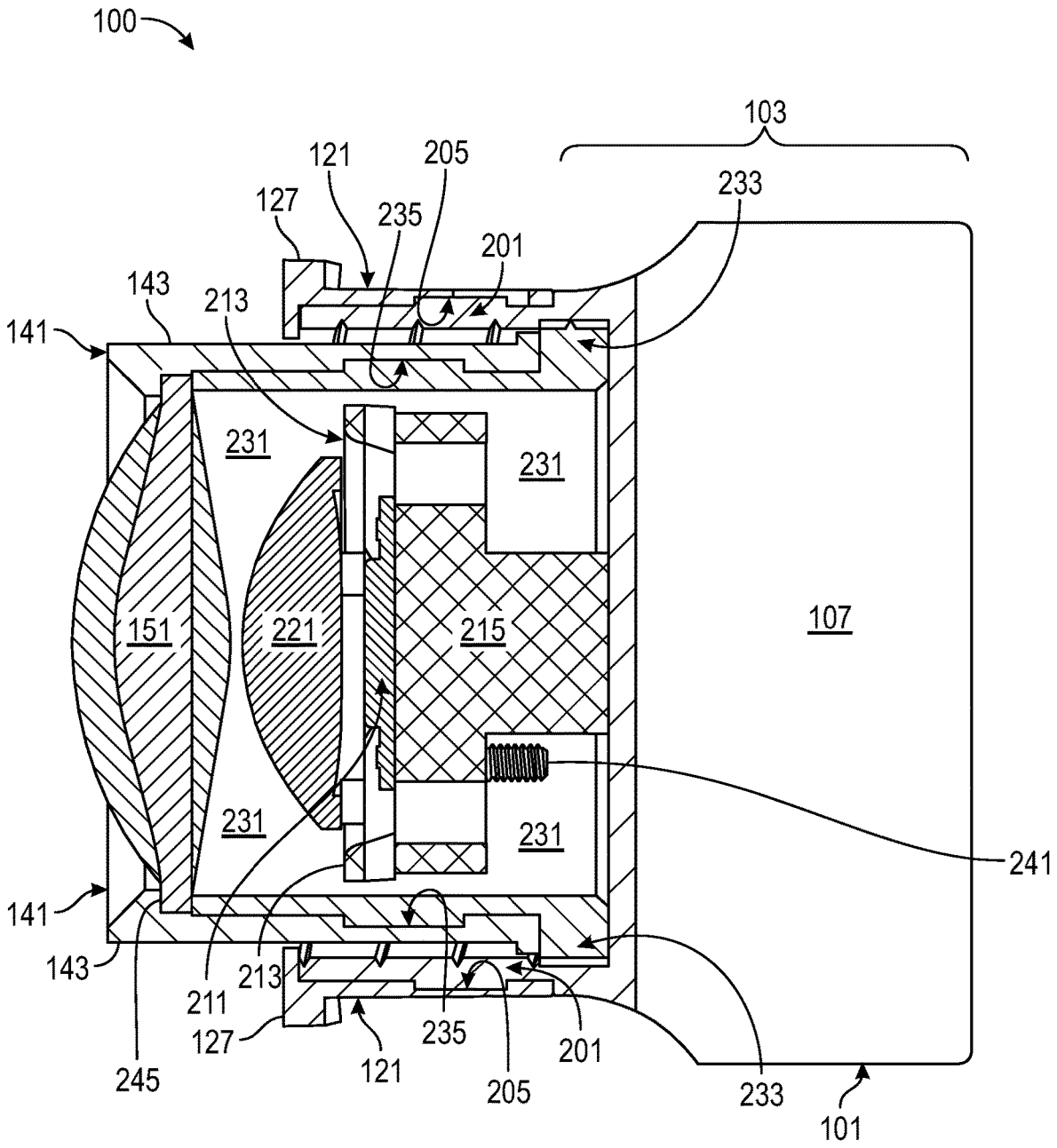
FIG. 2C depicts a cross-sectional view of downlight module with extendable lens 100 through/along sectional line 2C-2C from FIG. 1F.

FIG. 2A depicts a bottom perspective exploded view of a downlight module with extendable lens 100, in an exploded configuration along an axial (longitudinal) centerline 299. FIG. 2B depicts another bottom perspective exploded view of a downlight module with extendable lens 100, in an exploded configuration along an axial (longitudinal) centerline 299. And FIG. 2C depicts a cross-sectional view of downlight module with extendable lens 100 through/along sectional line 2C-2C from FIG. 1F. In some embodiments, downlight module with extendable lens 100 may comprise: heat sink module 101, mounting plate 215, LED chip 211, LED chip holder 213, fixed lens 221, top (inner) cylinder 231, telescopic lens 151, bottom (outer) telescopic cylinder 141, and telescopic holder 121. In some embodiments, downlight module with extendable lens 100 may additionally comprise electric power cable 161 and/or electrical power connector 163. Note, electric power cable 161 and electrical power connector 163 are not shown in FIG. 2A.

In some embodiments, heat sink module 101 may comprise top-portion 103 that may be located above and integrally attached to bottom-portion 201, wherein top-portion 103 may comprise a plurality of heat dissipation fins 107. FIG. 2A and FIG. 2B may also show portions of bottom-portion 201 of heat sink module 101. In some embodiments, when downlight module with extendable lens 100 may be in its assembled configuration, e.g., as shown in FIG. 1A to FIG. 1H, bottom-portion 201 may not be visible from an exterior of downlight module with extendable lens 100. In some embodiments, bottom-portion 201 may be substantially hollow cylindrical member that may be mostly (substantially) closed towards top 109 and mostly (substantially) open disposed away from top 109, forming an internal cavity 203. In some embodiments, internal cavity 203 may house at least portions of one or more of: mounting plate 215, LED chip 211, LED chip holder 213, fixed lends 221, top (inner) cylinder 231, fastener(s) 241, and a top portion of bottom (outer) telescopic cylinder 141. In some embodiments, internal/interior side-wall of internal cavity 203 may comprise threading for attachment of one or more of: mounting plate 215 and/or top (inner) cylinder 231; and this attachment may be removable in some embodiments. In some embodiments, mounting plate 215 may be attached to the (top) closed end of bottom-portion 201 using one or more fastener(s) 241.

Continuing discussing FIG. 2A, FIG. 2B, and FIG. 2C, in some embodiments, when downlight module with extendable lens 100 may be in its assembled configuration, bottom-portion 201 may be mostly (substantially) covered by telescopic holder 121. In some embodiments, when downlight module with extendable lens 100 may be in its assembled configuration, an exterior of bottom-portion 201 may be attached to an interior of telescopic holder 121; and this attachment may be removable in some embodiments. In some embodiments, bottom-portion 201 may comprise annular ring 205. In some embodiments, annular ring 205 may comprise outside threading. In some embodiments, telescopic holder 121 may comprise inside/interior threading on side-wall 123. In some embodiments, the inside/interior threading of side-wall 123 may complimentary attach to outside threading of annular ring 205 of bottom-portion 201.

Continuing discussing FIG. 2A, FIG. 2B, and FIG. 2C, in some embodiments, mounting plate 215 may be elevated, such that there may be a gap between mounting plate 215 and the (top) closed end of bottom-portion 201. In some embodiments, mounting plate 215 may be attached to bottom-portion 201 and/or to LED chip holder 213. In some embodiments, mounting plate 215 may be attached to the (top) closed end of bottom-portion 201 via one or more fasteners 241. In some embodiments, mounting plate 215 may be attached to LED chip holder 213 via one or more fasteners 241.

Continuing discussing FIG. 2A, FIG. 2B, and FIG. 2C, in some embodiments, LED chip 211 may be configured to emit light when appropriately energized from a connected electrical power source. In some embodiments, LED chip 211 may be operatively connected to an electrical power source (e.g., via electric power cable 161). In some embodiments, LED chip 211 may comprise one or more LEDs as well as additional circuitry. In some embodiments, LED chip 211 may be an off the shelf component. In some embodiments, light emitted by LED chip 211 may of a predetermined characteristic, such as, but not limited to, brightness, softness, wavelength, color, temperature, duration, portions thereof, combinations thereof, and/or the like. In some embodiments, LED chip 211 may be configured (e.g., positioned) to emit light downwards and through fixed (and closest) lens 221 and through telescopic lens 151. In some embodiments, LED chip 211 may be closer to fixed lens 221 than to telescopic lens 151. In some embodiments, a distance between LED chip 211 and fixed lens 221 may be fixed; whereas, a distance between LED chip 211 and telescopic lens 151 may vary within a predetermined range. In some embodiments, LED chip 211 may be attached to LED chip holder 213. In some embodiments fixed lens 221 and LED chip 211 may be disposed on different sides/surfaces of LED chip holder 213. In some embodiments fixed lens 221 and LED chip 211 may be attached to different/opposing sides/surfaces of LED chip holder 213.

Continuing discussing FIG. 2A, FIG. 2B, and FIG. 2C, in some embodiments, LED chip holder 213 may be attached to one or more of: LED chip 211, fixed lens 221, and/or mounting plate 215. In some embodiments, LED chip holder 213 may be mostly (substantially) disc like with a relatively large central hole to accommodate at least portion of LED chip 211 that has one or more LEDs. In some embodiments, LED chip holder 213 may have additional smaller hole(s) disposed around the relatively large central hole configured for receiving one or more fastener(s) 241. In some embodiments, disposed on opposite sides of the relatively large central hole may be two regions of rectangular cutouts.

Continuing discussing FIG. 2A, FIG. 2B, and FIG. 2C, in some embodiments, fixed lens 221 may be attached to a bottom side of LED chip holder 213. In some embodiments, fixed lens 221 may be attached to a bottom side of LED chip holder 213, via a snap fit, a friction fit, an interference fit, fastener 241, portions thereof, combinations thereof, and/or the like. In some embodiments, a bottom of fixed lens 221 may be convex (e.g., bulging downwards). In some embodiments, fixed lens 221 may be mostly (substantially) optically transparent (translucent) so as to permit passage of most of the light emitted from LED chip 211 through fixed lens 221. In some embodiments, when downlight module with extendable lens 100 may be in its assembled configuration, fixed lens 221 may have a fixed, static, non-variable, and/or non-moving relationship with LED chip holder 213, LED chip 211, mounting plate 215, heat sink module 101 (and all of its parts/regions), top (inner) cylinder 231, telescopic holder 121, and/or fastener(s) 241. In some embodiments, when downlight module with extendable lens 100 may be in its assembled configuration, fixed lens 221 may have a dynamic, variable, and/or moving/movable relationship with telescopic lens 151 and/or bottom (outer) telescopic cylinder 141 (within a predetermined range of motion). In some embodiments, fixed lens 221 may be mostly or partially located within internal cavity 203 of bottom-portion 201 and entirely located within bottom (outer) telescopic cylinder 141. In some embodiments, a bottom most portion of fixed lens 201 may extend down and beyond where internal cavity 203 ends (see e.g., FIG. 2C).

Continuing discussing FIG. 2A, FIG. 2B, and FIG. 2C, in some embodiments, top (inner) cylinder 231 may be substantially (mostly) hollow cylindrical member, that may be substantially (mostly) open at both axial terminal ends. In some embodiments, top (inner) cylinder 231 may be fixedly attached to bottom-portion 201. In some embodiments, outside threading on top (inner) cylinder 231 may be attached to inside threading of bottom-portion 201. In some embodiments, top (inner) cylinder 231 towards its top end may comprise a top flange 233. In some embodiments, top flange 233, around its outside periphery, may comprise outside threading. In some embodiments, this outside threading of top flange 233 may be complimentary attach to inside threading of bottom-portion 201. In some embodiments, top flange 233 may have an outside diameter that may be larger than the inside diameter of bottom (outer) telescopic cylinder 141. In some embodiments, top flange 233 may act as a stop with respect to upwards movement of bottom (outer) telescopic cylinder 141. In some embodiments, top (inner) cylinder 231 may comprise an annular ring 235. In some embodiments, annular ring 235, around its outside periphery, may comprise outside threading. In some embodiments, this outside threading of annular ring 235 may be complimentary attach to inside threading of bottom (outer) telescopic cylinder 141. In some embodiments, annular ring 235 may be an annular ring located on an exterior of top (inner) cylinder 231. In some embodiments, annular ring 235 may be located between top flange 233 and an axial bottom terminal end of top (inner) cylinder 231. In some embodiments, annular ring 235 may be located closer to top flange 233 than to the axial bottom terminal end of top (inner) cylinder 231.

Continuing discussing FIG. 2A, FIG. 2B, and FIG. 2C, in some embodiments, an outside diameter of extendable/telescopic lens 151 may be sized and an inside diameter of top (inner) cylinder 231 may be sized, such that extendable/telescopic lens 151 cannot pass inside of top (inner) cylinder 231. In some embodiments, the bottom axial terminal end of top (inner) cylinder 231 may act as a stop to extendable/telescopic lens 151 with respect to upwards movement of extendable/telescopic lens 151.

Continuing discussing FIG. 2A, FIG. 2B, and FIG. 2C, in some embodiments, top (inner) cylinder 231 may be referred to as "top" because top (inner) cylinder 231 may be higher in assembled downlight module with extendable lens 100 than bottom (outer) telescopic cylinder 141. In some embodiments, top (inner) cylinder 231 may be referred to as "inner" because top (inner) cylinder 231 may not be exteriorly visible in assembled downlight module with extendable lens 100; whereas, bottom portions of bottom (outer) telescopic cylinder 141 may be.

Continuing discussing FIG. 2A, FIG. 2B, and FIG. 2C, in some embodiments, a bottom of telescopic lens 151 may be convex. In some embodiments, telescopic lens 151 may be mostly (substantially) optically transparent (translucent) so as to permit passage of most of the light emitted from LED chip 211 and/or from fixed lens 221 through telescopic lens 151. In some embodiments, telescopic lens 151 may have a diameter that may be larger than (or the same as) the outside diameter of the axial bottom terminal end of top (inner) cylinder 231, such that telescopic lens 151 may not be located higher in assembled downlight module with extendable lens 100 than the axial bottom terminal end of top (inner) cylinder 231. In some embodiments, telescopic lens 151 may not pass into an inside of the axial bottom terminal end of top (inner) cylinder 231.

Continuing discussing FIG. 2A, FIG. 2B, and FIG. 2C, in some embodiments, telescopic lens 151 may be fixedly attached to an inside of bottom (outer) telescopic cylinder 141, such that when bottom (outer) telescopic cylinder 141 moves up or down, telescopic lens 151 moves up or down.

Continuing discussing FIG. 2A, FIG. 2B, and FIG. 2C, in some embodiments, telescopic lens 151 may not be attached to the inside of bottom (outer) telescopic cylinder 141; telescopic lens 151 may reside inside of bottom (outer) telescopic cylinder 141 but telescopic lens 151 may not pass out/through a bottom axial terminal end of bottom (outer) telescopic cylinder 141 (e.g., by virtue of an interference 245); and telescopic lens 151 may move downwards by gravity when bottom (outer) telescopic cylinder 141 is threaded downwards; and telescopic lens 151 may move upwards when bottom (outer) telescopic cylinder 141 is threaded upwards by bottom (outer) telescopic cylinder 141 pushing telescopic lens 151 upwards (via the interference 245).

Continuing discussing FIG. 2A, FIG. 2B, and FIG. 2C, in some embodiments, lens-interaction 245 may be structure inside of bottom (outer) telescopic cylinder 141, towards or at the bottom axial terminal end of 141. In some embodiments, lens-interaction 245 may be structure of bottom (outer) telescopic cylinder 141 that physically engages with at least a portion of an outside diameter telescopic lens 151. In some embodiments, lens-interaction 245 may prevent the outside diameter telescopic lens 151 from passing out/through the bottom axial terminal end of bottom (outer) telescopic cylinder 141. In some embodiments, lens-interaction 245 may attach to at least a portion of the outside diameter telescopic lens 151.

Continuing discussing FIG. 2A, FIG. 2B, and FIG. 2C, in some embodiments, when downlight module with extendable lens 100 may be in its assembled configuration, telescopic lens 151 (and/or bottom (outer) telescopic cylinder 141) may have a dynamic, variable, and/or moving/movable relationship with telescopic holder 121, top (inner) cylinder 231, fixed lens 221, LED chip holder 213, LED chip 211, mounting plate 215, and/or heat sink module 101 (within a predetermined range of motion). In some embodiments, extendable/telescopic lens 151 may be movable (translatable) in the up or the down direction, substantially parallel with axial (longitudinal) centerline 299, with respect to telescopic holder 121, top (inner) cylinder 231, fixed lens 221, LED chip holder 213, LED chip 211, mounting plate 215, and/or heat sink module 101 (within the predetermined range of motion).

Continuing discussing FIG. 2A, FIG. 2B, and FIG. 2C, in some embodiments, bottom (outer) telescopic cylinder 141 may be a substantially (mostly) cylindrical member, of rigid side-wall 143, with substantially (mostly) two open opposing ends at both axial terminal ends. In some embodiments, bottom (outer) telescopic cylinder 141 may house telescopic lens 151. In some embodiments, telescopic lens 151 may be located inside of bottom (outer telescopic cylinder 141. In some embodiments, an outside diameter of telescopic lens 151 may not pass below the bottom axial terminal end of bottom (outer) telescopic cylinder 141. In some embodiments, a center point (but not the outside diameter) of telescopic lens 151 may pass below the bottom axial terminal end of bottom (outer) telescopic cylinder 141. In some embodiments, most of the exterior sides of top (inner) cylinder 231, except for top flange 233, but including annular ring 235, may be located inside of bottom (outer)

telescopic cylinder 141. In some embodiments, bottom (outer telescopic cylinder 141 may be attached to top (inner) cylinder 231, such that bottom (outer telescopic cylinder 141 may rotate and move up or down with respect to top (inner) cylinder 231. In some embodiments, an upper region of bottom (outer) telescopic cylinder 141 may comprise inside/internal threading that may be configured to complimentary attach to outside threading of annular ring 235 of top (inner) cylinder 231. In some embodiments, at least some portions of side-wall 143 of bottom (outer) telescopic cylinder 141 may pass through the mostly (substantially) hollow interior of telescopic holder 121.

In some embodiments, bottom (outer) telescopic cylinder 141 comprises a lens-interaction 245 structure that may prevents an outside diameter of extendable/telescopic lens 151 from passing beyond a bottom axial terminal end of bottom (outer) telescopic cylinder 141 (see e.g., FIG. 2A, FIG. 2B, and FIG. 2C); however, in some embodiments, a bottom center (and not the outside diameter) of extendable/telescopic lens 151 may extend beyond the bottom axial terminal end of bottom (outer) telescopic cylinder 141. See e.g., FIG. 1D through FIG. 1G.

In some embodiments, with respect to bottom (outer) telescopic cylinder 141, "bottom" may refer to bottom (outer) telescopic cylinder 141 being located lower in assembled downlight module with extendable lens 100 as compared against top (inner) cylinder 231. In some embodiments, with respect to bottom (outer) telescopic cylinder 141, "outer" may refer to bottom (outer) telescopic cylinder 141 being at least exteriorly visible in assembled downlight module with extendable lens 100; whereas, top (inner) cylinder 231 may not be exteriorly visible in assembled downlight module with extendable lens 100.

In some embodiments, a top of top (inner) cylinder 231 (e.g., top flange 233) may be located higher than a top of bottom (outer) telescopic cylinder 141, with respect to the assembled configuration of downlight module with extendable lens 100. In some embodiments, a bottom of bottom (outer) telescopic cylinder 141 may be located lower than a bottom of top (inner) cylinder 231, with respect to the assembled configuration of downlight module with extendable lens 100. In some embodiments, the bottom of bottom (outer) telescopic cylinder 141 may be spaced apart from the bottom of top (inner) cylinder 231, with respect to the assembled configuration of downlight module with extendable lens 100; and in some embodiments, within this space may be telescopic lens 151. See e.g., FIG. 2A, FIG. 2B, and FIG. 2C.

Continuing discussing FIG. 2A, FIG. 2B, and FIG. 2C, in some embodiments, telescopic holder 121 may be a substantially (mostly) cylindrical member, of rigid side-wall 123, with substantially (mostly) two open opposing ends at both axial terminal ends. In some embodiments, telescopic holder 121 may act/function as a sleeve, that may entirely (or mostly) cover over top (inner) cylinder 231 and bottom-portion 201. In some embodiments, telescopic holder 121 may be attached to bottom-portion 201. In some embodiments, telescopic holder 121 may comprise inside/interior threading on side-wall 123. In some embodiments, the inside/interior threading of side-wall 123 may complimentary attach to outside threading of annular ring 205 of bottom-portion 201. In some embodiments, bottom/lower portions of bottom (outer) telescopic cylinder 141 may pass through the hollow interior of telescopic holder 121. In some embodiments, bottom/lower portions of bottom (outer) telescopic cylinder 141 may protrude beyond a bottom of telescopic holder 121. In some embodiments, side-wall 123 may comprise one or more hole(s) 125, that may pass entirely through side-wall 123. In some embodiments, hole(s) 125 may be oval and/or circular in shape. In some embodiments, a bottom portion of telescopic holder 121 may comprise flange 127. In some embodiments, flange 127 may be disposed opposite from top flange 233. In some embodiments, flange 127 may be disposed opposite from a top flange of bottom (outer) telescopic holder 141. In some embodiments, flange 127 may comprise a notch 129 and/or teeth 131.

Continuing discussing FIG. 2A, FIG. 2B, and FIG. 2C, in some embodiments, downlight module with extendable lens 100 may additionally comprise one or more fasteners 241. In some embodiments, fastener(s) 241 may be used to attach: fixed lens 221 to LED chip holder 213; LED chip holder 213 to LED chip 211; LED chip holder 213 to mounting plate 215; mounting plate 215 to bottom-portion 201; portions thereof; combinations thereof; and/or the like; and in some embodiments, such attachment may be removable or intended to be permanent. In some embodiments, fastener 241 may be selected from one or more of: a screw, a bolt, a rivet, a rod, a pin, a dowel, a nail, threading, Velcro or Velcro like (e.g., plurality of hooks and complimentary plurality of loops), a mechanical fastener, a weld, a heat weld, a solvent bond/weld, an ultrasonic weld, an adhesive, a glue, an epoxy, a cement, thread lock, tape, friction fit, interference fit, snap fit, portions thereof, combinations thereof, and/or the like.

Continuing discussing FIG. 2A, FIG. 2B, and FIG. 2C, in some embodiments, in a given downlight module with extendable lens 100, telescopic holder 121, bottom (outer) telescopic cylinder 141, telescopic lens 151, top (inner) cylinder 231, fixed lens 221, LED chip holder 213, LED chip 211, mounting plate 215, and heat sink module 101, may be concentrically oriented with respect to each other along axial (longitudinal) centerline 299.

In some embodiments, downlight module with extendable lens 100 may comprise heat sink module 101, top (inner) cylinder 231, bottom (outer) telescopic cylinder 141, telescopic holder 121, fixed lens 221, and telescopic/extendable lens 151. See e.g., FIG. 1A through FIG. 3B.

In some embodiments, heat sink module 101 may comprise bottom-portion 201. In some embodiments, 201 may be a first hollow cylindrical member that may be at least substantially closed at a top-end of bottom-portion 201 and substantially open at a bottom-end of the bottom-portion 201. In some embodiments, bottom-portion 201 may comprise a first cylindrical side-wall, such that an internal cavity 203 may be defined within bottom-portion 201. See e.g., FIG. 2A, FIG. 2B, and FIG. 2C.

In some embodiments, top-inner cylinder 231 may be a second hollow cylindrical member that may be substantially open at both axial terminal ends of top-inner cylinder 231. In some embodiments, a first outside portion (e.g., top flange 233) of top-inner cylinder 231 may be attached to an inside of the first cylindrical side-wall of the internal cavity 203 of bottom-portion 201. See e.g., FIG. 2A, FIG. 2B, and FIG. 2C.

In some embodiments, bottom-outer telescopic cylinder 141 may be a third hollow cylindrical member that may be substantially open at both axial terminal ends of the bottom-outer telescopic cylinder 141. See e.g., FIG. 2A, FIG. 2B, and FIG. 2C.

In some embodiments, telescopic holder 121 may be a fourth hollow cylindrical member that may be substantially open at both axial terminal ends of telescopic holder 121. In some embodiments, an inside portion of telescopic holder 121 may be attached to an outside portion (e.g., annular ring 205) of the first cylindrical side-wall of bottom-portion 201 (e.g., via a threaded connection). In some embodiments, exterior portions of bottom (outer) telescopic cylinder 141, the top (inner) cylinder 231, and bottom-portion 201 may be located within telescopic holder 121. See e.g., FIG. 2A, FIG. 2B, and FIG. 2C.

In some embodiments, fixed lens 221 may be disposed at least partially within the internal cavity 203 and entirely disposed within top-inner cylinder 231. In some embodiments, fixed lens 221 may be positionally fixed and non-movable with respect to telescopic holder 121, top (inner) cylinder 231, and heat sink module 101. See e.g., FIG. 2A, FIG. 2B, and FIG. 2C.

In some embodiments, extendable/telescopic lens 151 may be located within bottom (outer) telescopic cylinder 141. See e.g., FIG. 2A, FIG. 2B, and FIG. 2C.

In some embodiments, an inside portion of the bottom-outer telescopic cylinder may be operatively linked with a second outside portion (e.g., annular ring 235) of top (inner) cylinder 231, such that bottom (outer) telescopic cylinder 141 may be translatable in an up or a down motion/direction that may be substantially parallel with a common axial centerline 299 of downlight module with extendable lens 100 in its assembled configuration. See e.g., FIG. 2A, FIG. 2B, and FIG. 2C.

In some embodiments, the operative linkage between the inside portion of bottom (outer) telescopic cylinder 141 and second outside portion (e.g., annular ring 235) of top (inner) cylinder 231 may be from a threaded connection, such that the up or the down motion may be generated by rotating bottom (outer) telescopic cylinder 141 around common axial centerline 299 (and/or around annular ring 235/top (inner) cylinder 231). See e.g., FIG. 2A through FIG. 3B.

In some embodiments, the operative linkage between the inside portion of bottom (outer) telescopic cylinder 141 and second outside portion (e.g., annular ring 235) of top (inner) cylinder 231 may be from a friction fit (interference fit), such that the up or the down motion may be generated by pushing or pulling on bottom (outer) telescopic cylinder 141. See e.g., FIG. 2A through FIG. 3B.

In some embodiments, the first outside portion of top (inner) cylinder 231 may be top flange 233 that may be located at a top of top (inner) cylinder 231. In some embodiments, the second outside portion of top (inner) cylinder 231 may be annular ring 235. In some embodiments, annular ring 235 may be disposed between top flange 233 and the axial bottom terminal end of top (inner) cylinder 231. In some embodiments, annular ring 235 may be located closer to top flange 233 than to the axial bottom terminal end of top (inner) cylinder 231. See e.g., FIG. 2A, FIG. 2B, and FIG. 2C.

In some embodiments, telescopic holder 121 may comprises a second cylindrical side-wall 123. In some embodiments, second cylindrical side-wall 123 may comprise at least one through hole 125. In some embodiments, a given hole 125 may be configured to receive an orthogonal set screw (not shown) to positionally fix telescopic holder 121 to bottom-portion 201. See e.g., FIG. 2A, FIG. 2B, and FIG. 2C.

In some embodiments, downlight module with extendable lens 100 may comprise heat sink module 101, top (inner) cylinder 231, bottom (outer) telescopic cylinder 141, telescopic holder 121, fixed lens 221, telescopic/extendable lens 151, and LED chip 211. In some embodiments, downlight module with extendable lens 100 may further comprise one or more of: LED chip holder 213, mounting plate 215, fastener 241, electric power cable 161, electrical power connector 163, portions thereof, combinations thereof, and/or the like. See e.g., FIG. 1A through FIG. 3B. In some embodiments, LED chip 211 may be configured to emit light upon receiving electrical power. In some embodiments, fixed lens 221 may be disposed between LED chip 211 and extendable/telescopic lens 151, with LED chip 211 being located closest to the top-end of bottom-portion 201. In some embodiments, LED chip 211 may be coupled to LED chip holder 213. In some embodiments, LED chip 211 may be coupled to a top of LED chip holder 213. In some embodiments, fixed lens 221 may be coupled to (a bottom of) LED chip holder 213. In some embodiments, mounting plate 213 may be attached bottom-portion 201 within internal cavity 203. In some embodiments, mounting plate 213 may be attached to the top-end of bottom-portion 201 within internal cavity 203 (via one or more fasteners 241). In some embodiments, LED chip holder 213 (with attached LED chip 211) may be attached to mounting plate 215. See e.g., FIG. 2A, FIG. 2B, and FIG. 2C.

In some embodiments, a greatest diameter of downlight module with extendable lens 100 may be an exterior/outside diameter of the finned portion of top-portion 103. In some embodiments, the exterior/outside diameter of the finned portion of top-portion 103 may be larger than an exterior/outside diameter of a non-finned portion of top-portion 103. In some embodiments, the non-finned portion of top-portion 103 may be closer to bottom-portion 201 than the finned portion of top-portion 103. In some embodiments, the non-finned portion of top-portion 103 may transition smoothly and/or seamlessly into bottom-portion 201. In some embodiments, the exterior/outside diameter of the non-finned portion of top-portion 103 may be larger than an outside diameter of bottom-portion 201. See e.g., FIG. 2C and FIG. 1G.

In some embodiments, the outside diameter of bottom-portion 201 may be larger than an exterior/outside diameter of bottom (outer) telescopic cylinder 141. In some embodiments, the outside diameter of bottom-portion 201 may be at least mostly larger than an outside diameter of top (inner) cylinder 231. See e.g., FIG. 2C and FIG. 1G.

In some embodiments, the exterior/outside diameter of bottom (outer) telescopic cylinder 141 may be at least mostly larger than the outside diameter of top (inner) cylinder 231, except that top flange 233 may have an outside diameter that may be the same or greater than the exterior/outside diameter of bottom (outer) telescopic cylinder 141. In some embodiments, the exterior/outside diameter of bottom (outer) telescopic cylinder 141 may be larger than an outside diameter of telescopic lens 151. See e.g., FIG. 2C and FIG. 1G.

In some embodiments, the outside diameter of telescopic lens 151 may be at least mostly larger than the outside diameter of top (inner) cylinder 231, except that top flange 233 may have the outside diameter that may be greater than the outside diameter of telescopic lens 151. In some embodiments, the outside diameter of telescopic lens 151 may be larger than an interior/inside diameter of top (inner) cylinder 231 (such that telescopic lens 151 cannot fit into top (inner) cylinder 231). In some embodiments, the outside diameter of telescopic lens 151 may be larger than an outside diameter of fixed lens 221. See e.g., FIG. 2C and FIG. 1G.

In some embodiments, the interior/inside diameter of top (inner) cylinder 231 may be larger than the outside diameter of fixed lens 221. In some embodiments, the interior/inside diameter of top (inner) cylinder 231 may be larger than an outside diameter of LED chip holder 213. In some embodiments, the interior/inside diameter of top (inner) cylinder 231 may be larger than an outside diameter of LED chip 211. In some embodiments, the interior/inside diameter of top (inner) cylinder 231 may be larger than an outside diameter(s) of mounting plate 215. See e.g., FIG. 2C and FIG. 1G.

In some embodiments, the outside diameter of LED chip holder 213 may be larger than the outside diameter of fixed lens 221. In some embodiments, the outside diameter of LED chip holder 213 may be larger than the outside diameter of LED chip 211. In some embodiments, the outside diameter of LED chip holder 213 may be larger than the outside diameter(s) of mounting plate 215. See e.g., FIG. 2C and FIG. 1G.

In some embodiments, the outside diameter of fixed lens 221 may be larger than the outside diameter of LED chip 211. In some embodiments, the outside diameter of fixed lens 221 may be larger than the outside diameter(s) of mounting plate 215. In some embodiments, mounting plate 215 may have two different outside diameters, wherein the smaller such outside diameter may be associated with the stand-off portion of mounting plate 215 that may be in physical communication with the top closed-end of bottom-portion 201. See e.g., FIG. 2C and FIG. 1G.

Figure 3A:
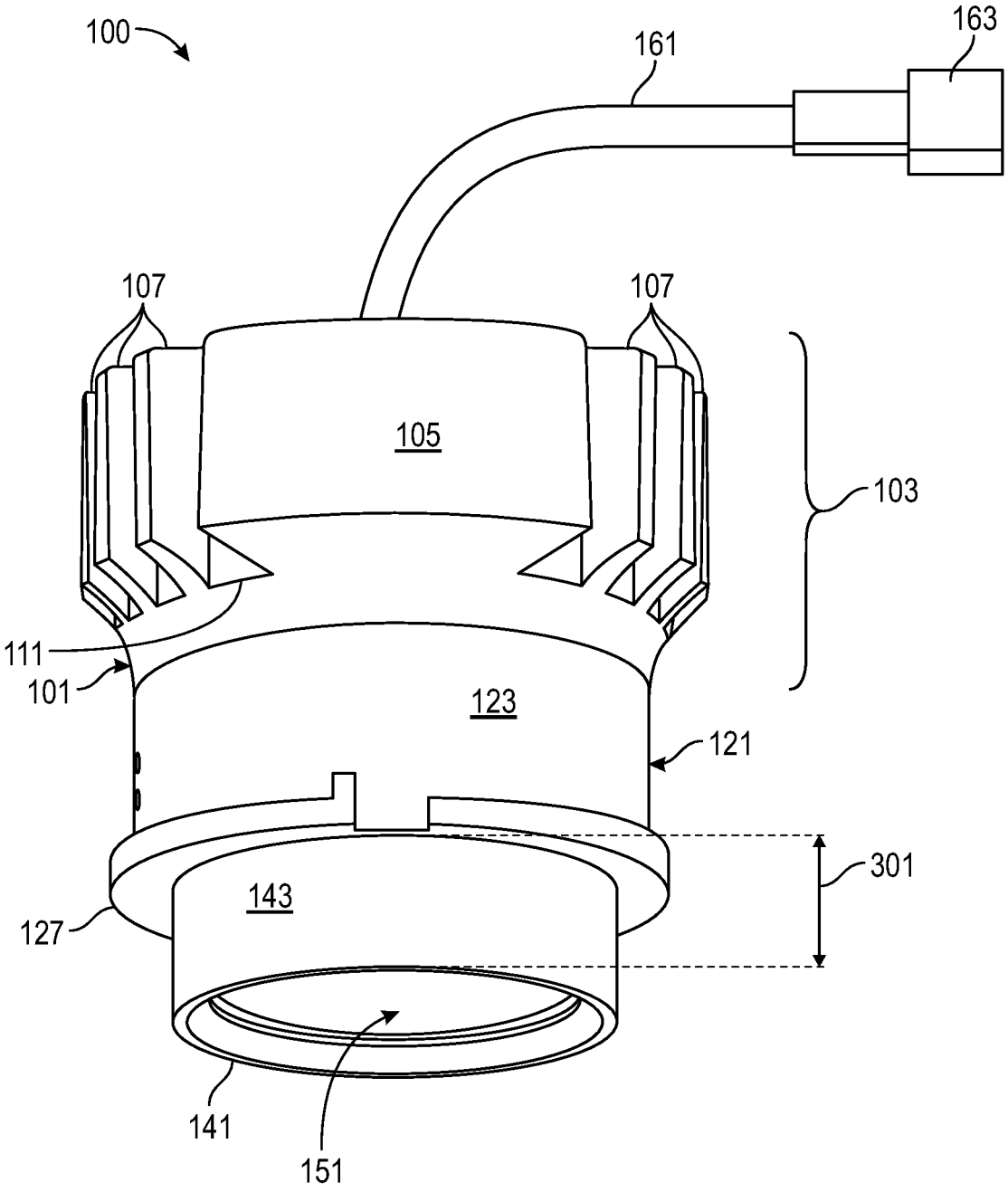
FIG. 3A depicts a bottom perspective view of the downlight module with extendable lens of FIG. 1A, in an assembled configuration, with a telescopic lens and a bottom (outer) telescopic cylinder in a minimum extension position.

FIG. 3A depicts a bottom perspective view of a downlight module with extendable lens 100, in an assembled configuration, with telescopic lens 151 and bottom (outer) telescopic cylinder 141 in a minimum extension 301 position. In some embodiments, minimum extension 301 may be from a bottom of bottom (outer) telescopic cylinder 141 to a bottom of flange 127. In some embodiments, minimum extension 301 may be a predetermined and fixed distance/dimension. In some embodiments, minimum extension 301 may be selected from a range of predetermined distances/dimensions. In some embodiments, minimum extension 301 may be fifty-six (56) millimeters (mm), plus or minus five (5) mm. In some embodiments, minimum extension 301 may be another predetermined and fixed distance/dimension.

Figure 3B:
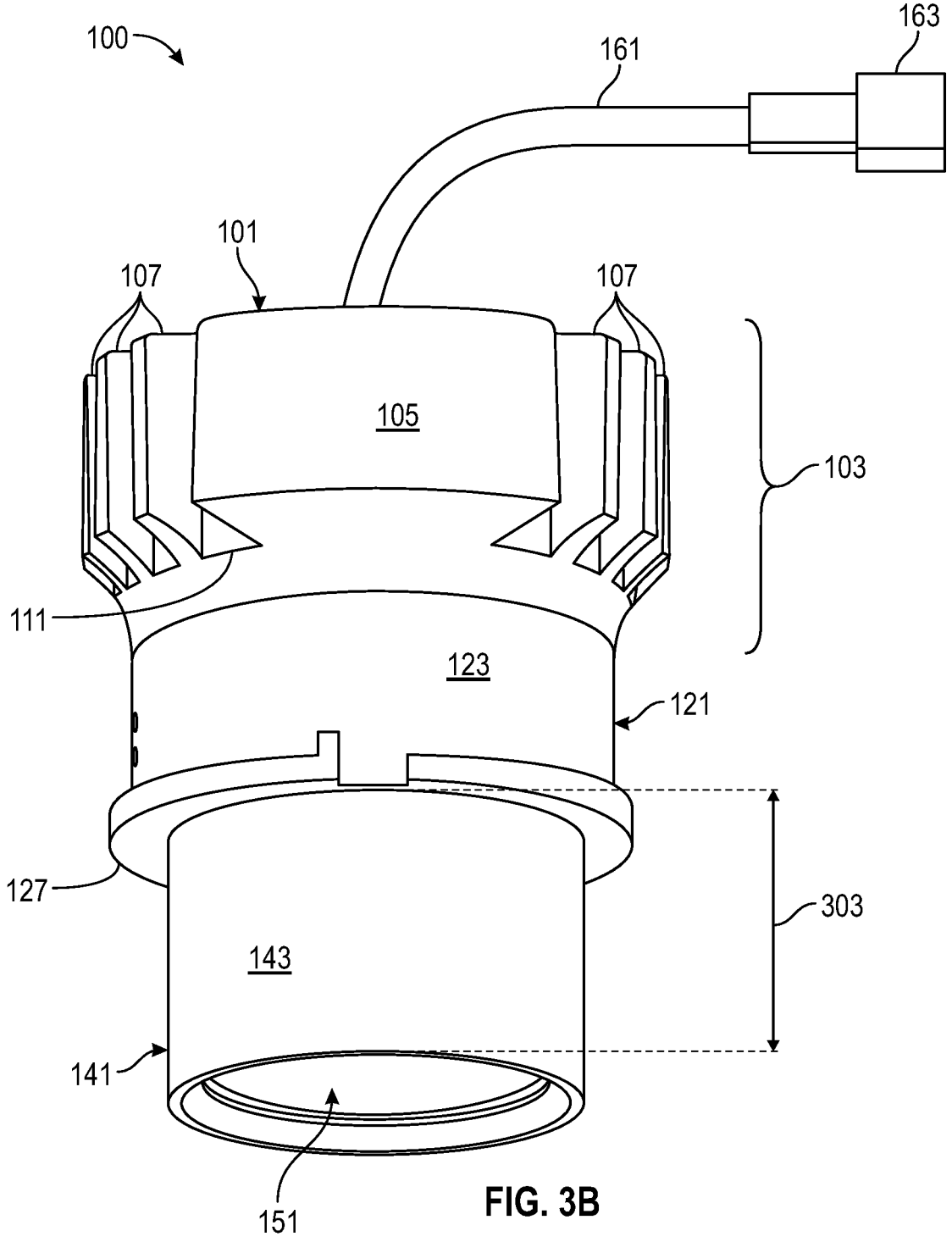
FIG. 3B depicts a bottom perspective view of the downlight module with extendable lens of FIG. 1A, in an assembled configuration, with the telescopic lens and the bottom (outer) telescopic cylinder in a maximum extension position.

FIG. 3B depicts a bottom perspective view of a downlight module with extendable lens 100, in an assembled configuration, with telescopic lens 151 and bottom (outer) telescopic cylinder 141 in a maximum extension 303 position. In some embodiments, maximum extension 303 may be from a bottom of bottom (outer) telescopic cylinder 141 to a bottom of flange 127. In some embodiments, maximum extension 303 may be a predetermined and fixed distance/dimension. In some embodiments, maximum extension 303 may be selected from a range of predetermined distances/dimensions. In some embodiments, maximum extension 303 may be seventy-eight (78) millimeters (mm), plus or minus five (5) mm. In some embodiments, maximum extension 303 may be another predetermined and fixed distance/dimension.

In some embodiments, when downlight module with extendable lens 100 may be in the minimum extension 301 configuration, an emitted light cone may be wider/broader as compared to when downlight module with extendable lens 100 may be in the maximum extension 303 configuration, when the emitted light cone may be narrower.

In some embodiments, the up or the down motion of bottom (outer) telescopic cylinder 141 may be limited to a predetermined range of motion from minimum extension 301 to maximum extension 303 of bottom (outer) telescopic cylinder 141. In some embodiments, when downlight module with extendable lens 100 may be in minimum extension 301 configuration, a bottom axial terminal end of bottom (outer) telescopic cylinder 141 may be extended beyond a bottom flange 127 of telescopic holder 121 a first fixed distance; and when downlight module with extendable lens 100 may be in maximum extension 303 configuration the bottom axial terminal end of bottom (outer) telescopic cylinder 141 may be extended further beyond the bottom flange 127 of telescopic holder 121 to a second fixed distance, wherein the second fixed distance may be greater than the first fixed distance. In some embodiments, first fixed distance may be fifty-six (56) millimeters (mm), plus or minus five (5) mm. In some embodiments, second fixed distance may be seventy-eight (78) millimeters (mm), plus or minus five (5) mm. See e.g., FIG. 3A and FIG. 3B.

Figure 4A:
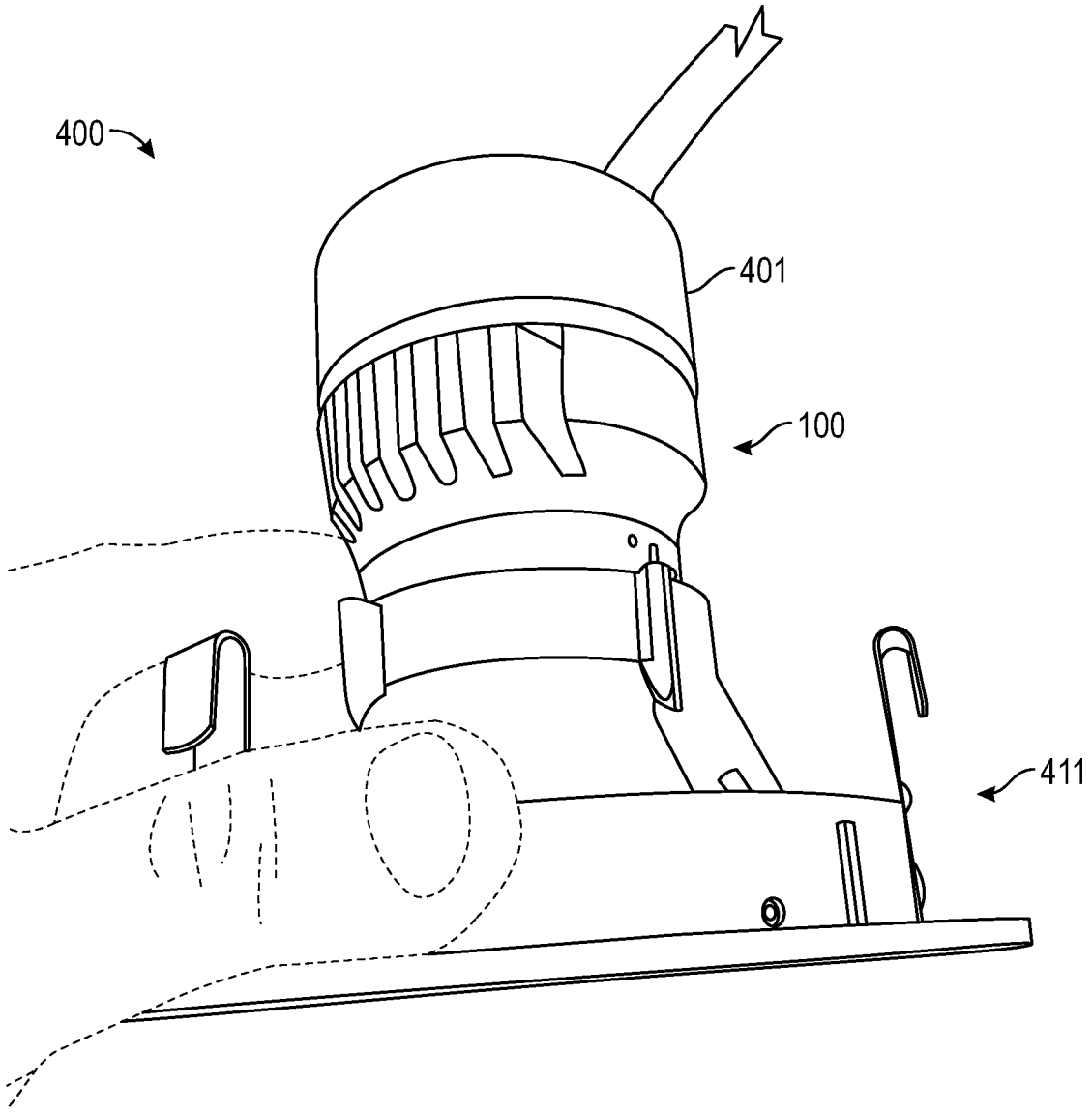
FIG. 4A may show a human hand holding the downlight module with extendable lens of FIG. 1A, wherein the downlight module with extendable lens of FIG. 1A may be attached to a driver cap and/or to a trim, shown from a partially front and partially side view.

FIG. 4A may show a human hand holding a downlight module with extendable lens 100, wherein the downlight module with extendable lens 100 may be attached to a driver cap 401 and a trim 411, from a partially front and partially side view. In some embodiments, driver cap 401 may be attached on top of heat sink module 101. In some embodiments, driver cap 401 may comprise an electrical power driver that may be operatively connected to LED chip 211 to power, manage, and/or control LED chip 211. In some embodiments, trim 411 may be attached to downlight module with extendable lens 100. In some embodiments, trim 411 may be attached to downlight module with extendable lens 100 by using notches 129 and teeth 131. In some embodiments, the bottom axial terminal end of 141 may be extendable past a bottom flat flange surface of trim 411.

Figure 4B:
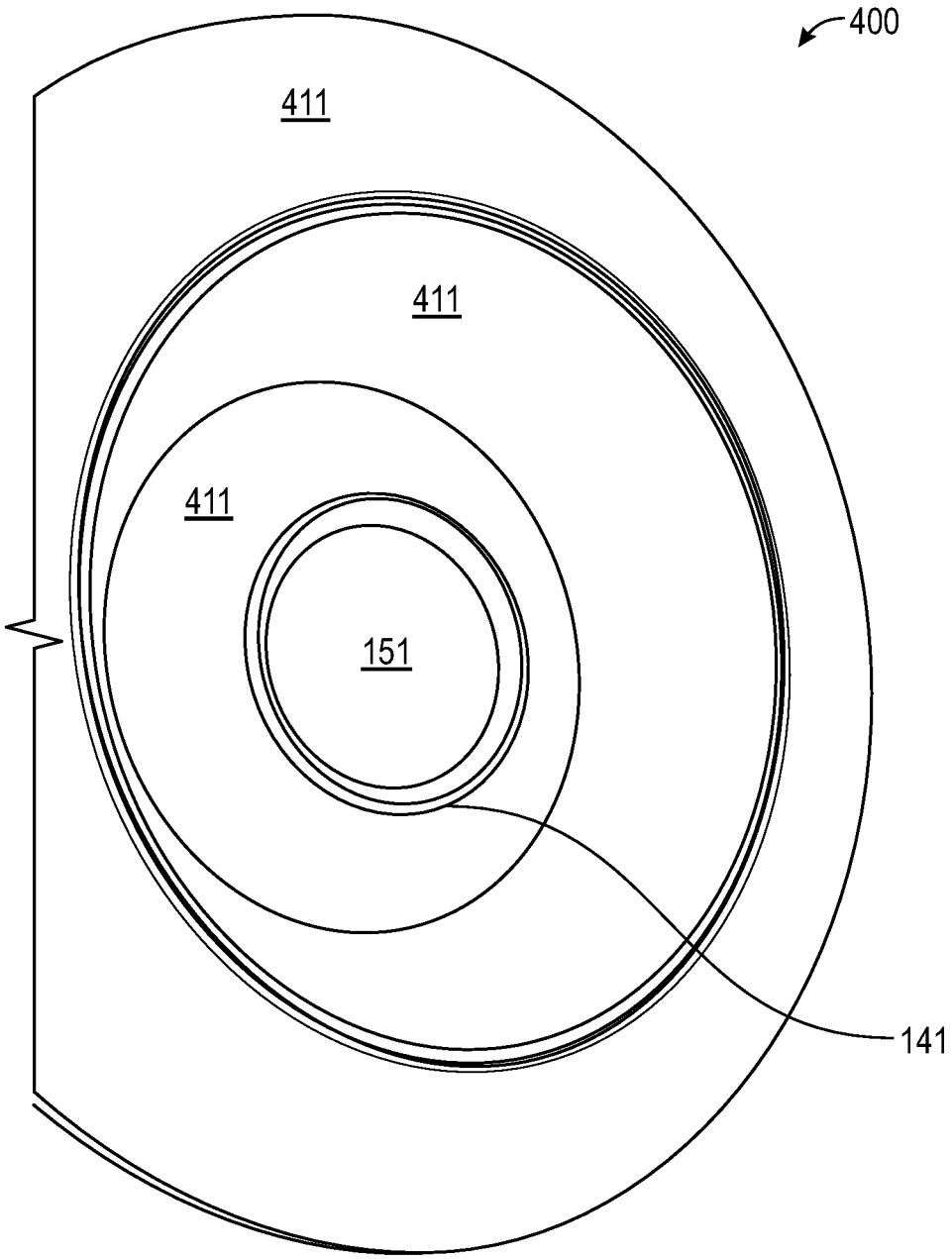
FIG. 4B may show the downlight module with extendable lens of FIG. 1A that may be attached to the trim, shown from a mostly bottom view.

FIG. 4B may show downlight module with extendable lens 100 may be attached to a trim 411, from a mostly bottom view. In some embodiments, when downlight module with extendable lens 100 may be attached to trim 411, telescopic lens 151 and a bottom portion of bottom (outer) telescopic cylinder 141 may be visible from the bottom of trim 411.

Figure 4C:
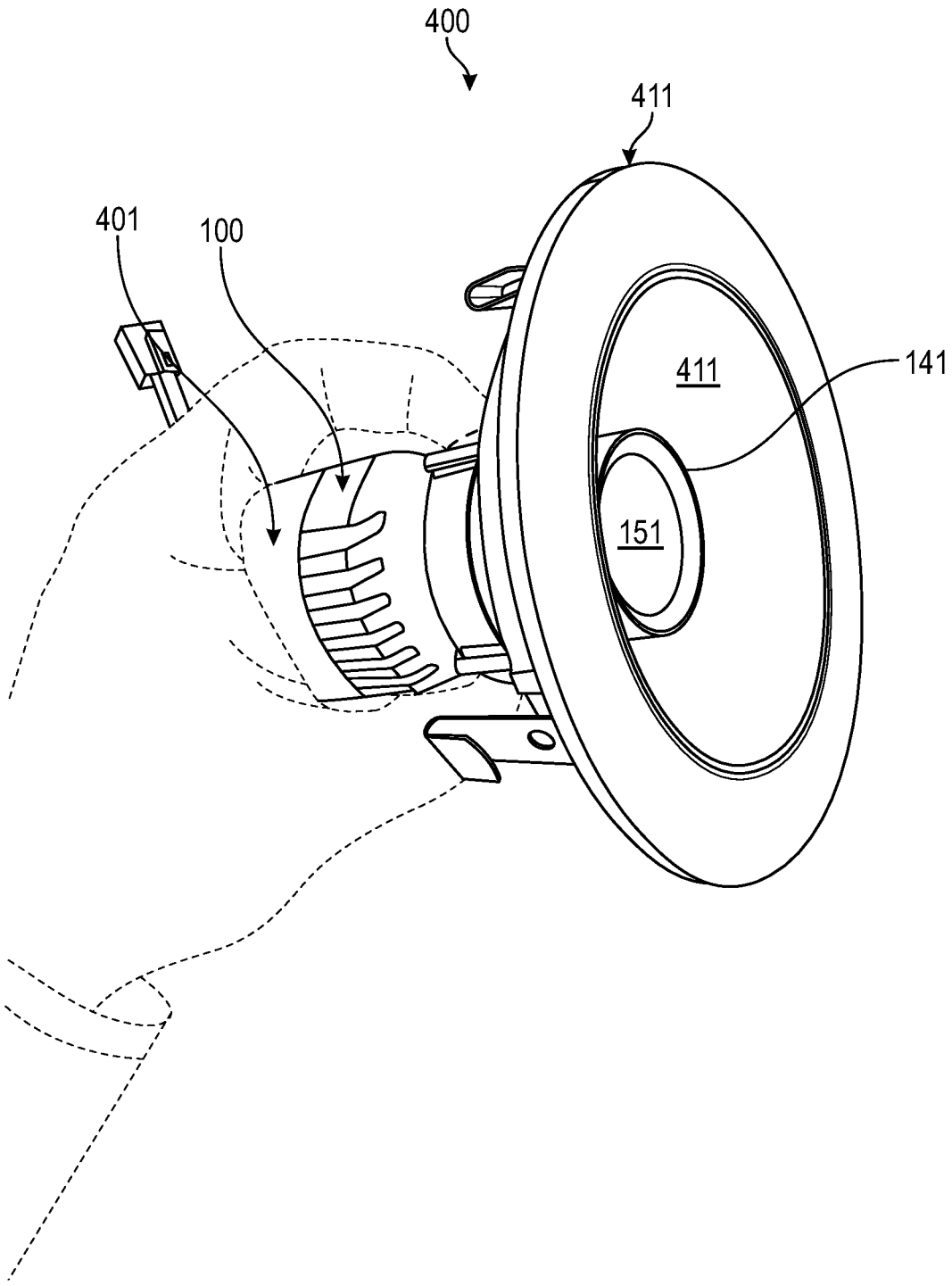
FIG. 4C may show a human hand holding the downlight module with extendable lens of FIG. 1A, wherein the downlight module with extendable lens of FIG. 1A may be attached to the driver cap and/or to the trim, shown from a bottom perspective view.

FIG. 4C may show a human hand holding a downlight module with extendable lens 100, wherein the downlight module with extendable lens 100 may be attached to driver cap 401 and trim 411, from a bottom perspective view. In some embodiments, when downlight module with extendable lens 100 may be attached to trim 411, telescopic lens 151 and a bottom portion of bottom (outer) telescopic cylinder 141 may be visible from the bottom of trim 411.

FIG. 4A, FIG. 4B, and/or FIG. 4C may illustrate how in use, downlight module with extendable lens 100 may be attached to driver cap 401 and/or to trim 411 to form assembly 400. In some embodiments, assembly 400 may comprise downlight module with extendable lens 100, driver cap 401, and trim 411.

In some embodiments, top-portion 103 may comprise at least one hole 113 that may be configured to provide a means (along with appropriate fastener(s)) for attachment of a driver cap 401 to top-portion 103. In some embodiments, driver cap 401 may be configured to provide electrical power to LED chip 211 of downlight module with extendable lens 100. See e.g., FIG. 2A, FIG. 2B, FIG. 4A, and FIG. 4C.

Figure 5A:
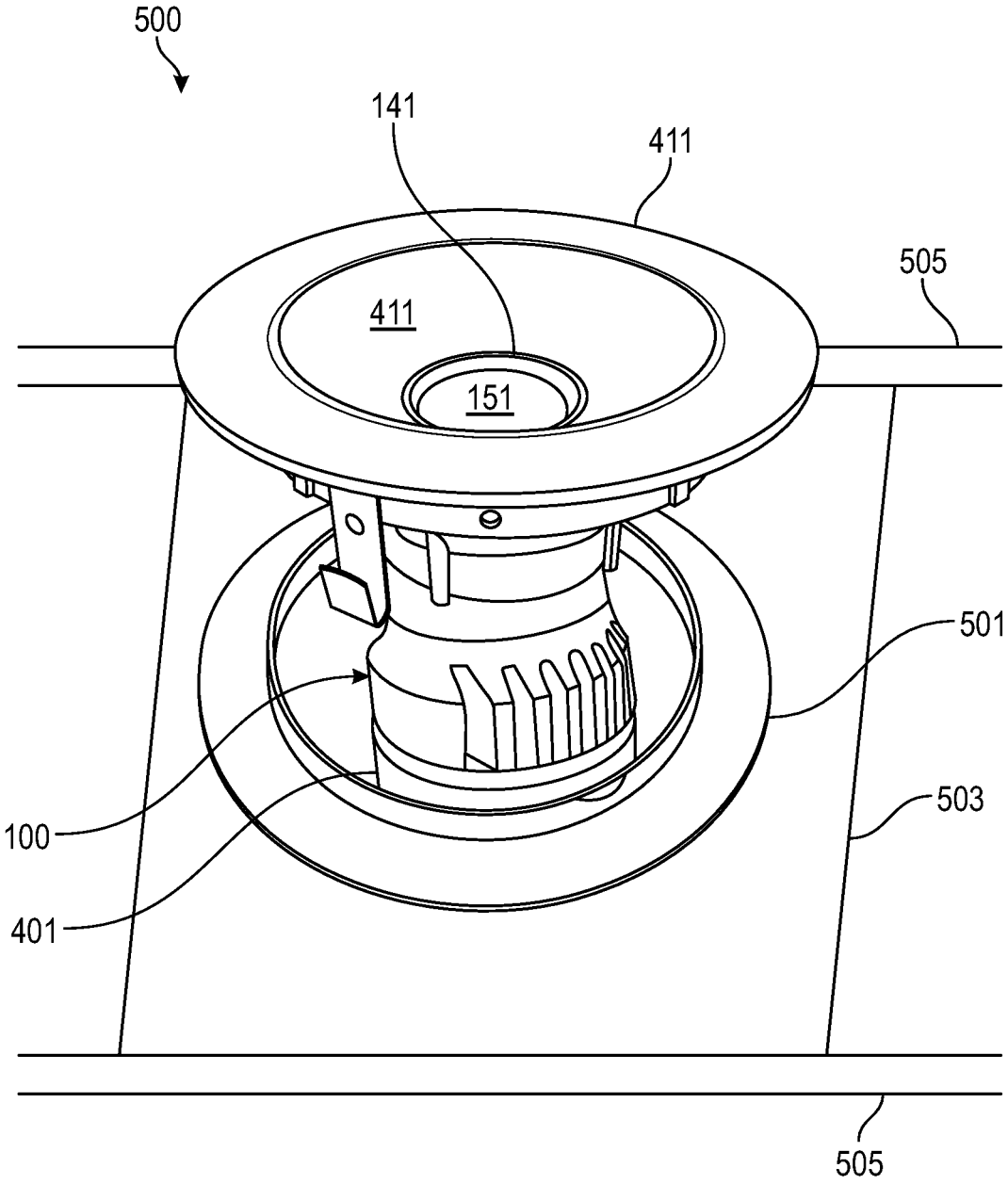
FIG. 5A may be a bottom perspective view, showing the assembly of the downlight module with extendable lens of FIG. 1A, with the driver cap and with the trim, being inserted into a can that is attached to a frame, to form a new assembly that may comprise the downlight module with extendable lens, the driver cap, the trim, the can, and (optionally) the frame.

FIG. 5A may be a bottom perspective view, showing assembly 400 being inserted into a can 501 that is attached to frame 503, to form an assembly 500. In some embodiments, assembly 500 may comprise assembly 400 and can 501. In some embodiments, assembly 500 may comprise assembly 400, can 501, and frame 503. In some embodiments, can 501 may be attached to frame 503. In some embodiments, can 501 may be configured to receive most of assembly 400. In some embodiments, can 501 and frame 503 may be located above a ceiling. In some embodiments, frame 503 may be attached to joists and/or other/similar structural members above the ceiling. In some embodiments, frame 503 may have or may be attached to hanger bars 505. In some embodiments, hanger bars 505 may be attached joists and/or other/similar structural members above the ceiling.

Figure 5B:
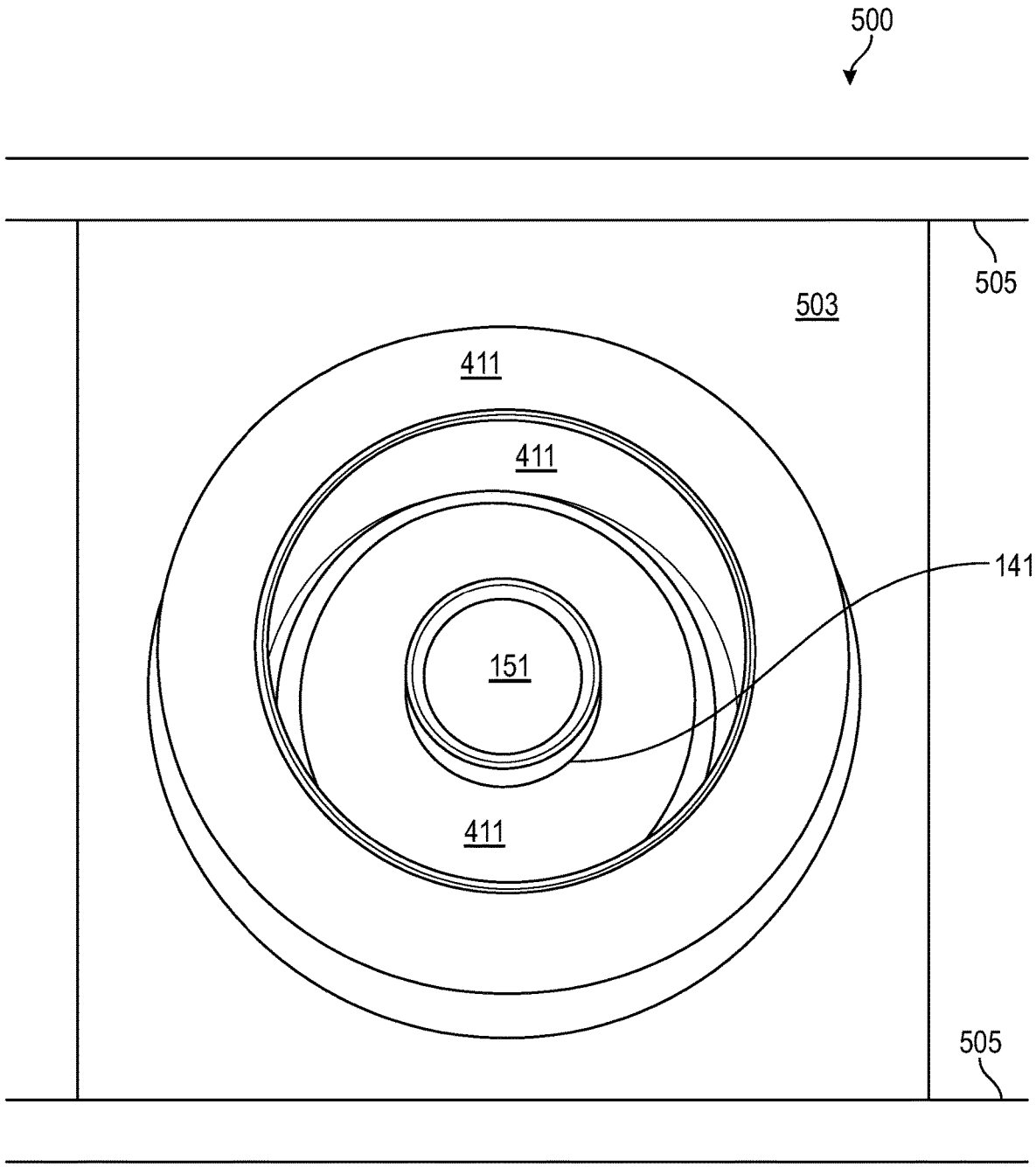
FIG. 5B may be a bottom perspective view, showing the new assembly that was being formed in FIG. 5A.

FIG. 5B may be a bottom perspective view, showing assembly 400 inserted into and/or attached to can 501 that is attached to frame 503, forming assembly 500. Note, can 501 may not be visible in FIG. 5B (as can 501 would be projecting into the page of the FIG. 5B).

Figure 5C:
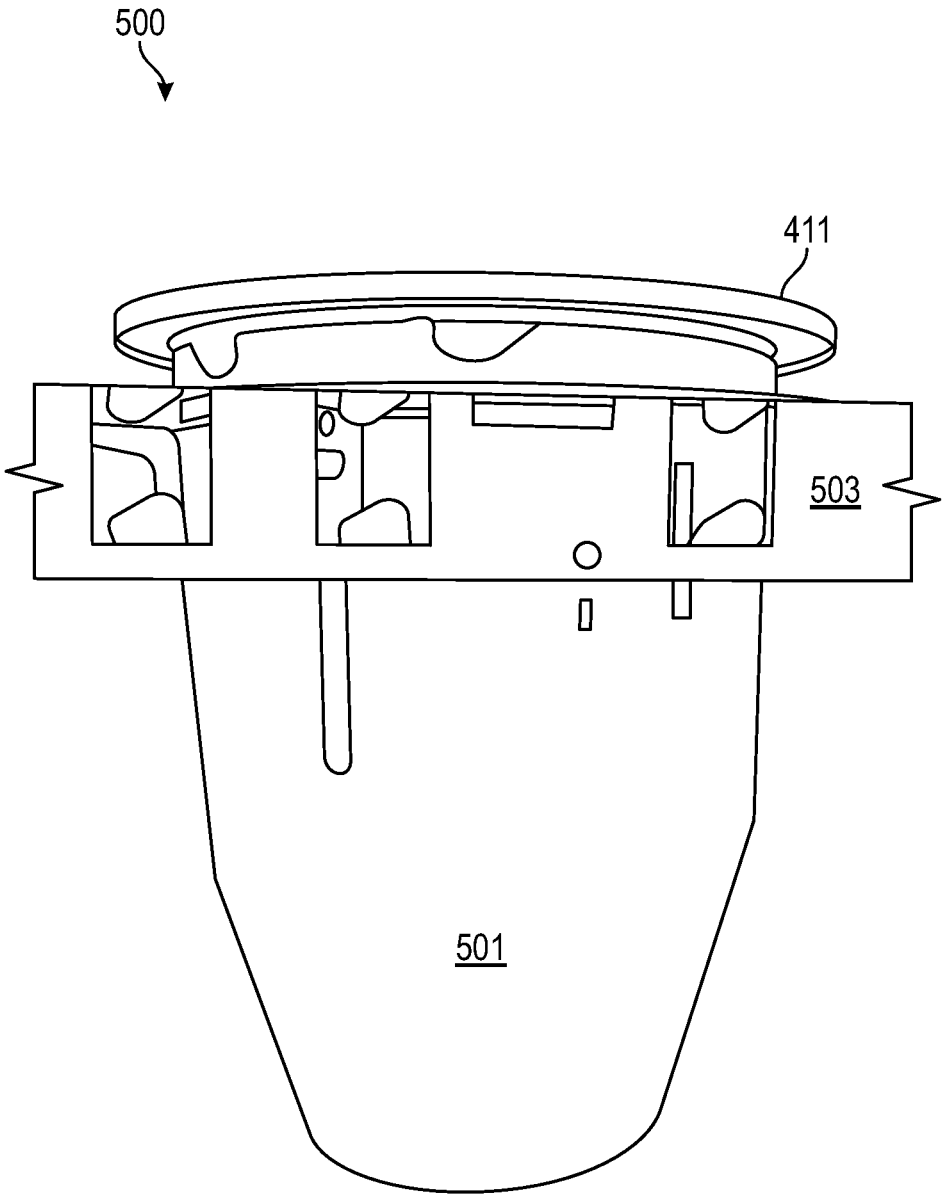
FIG. 5C may be a side perspective view of the new assembly of FIG. 5B that may comprise the downlight module with extendable lens, the driver cap, the trim, the can, and (optionally) the frame.

FIG. 5C may be a side perspective view of assembly 500.

In some embodiments, a light system may comprise at least one downlight module with extendable lens 100 and one or more of: driver cap 401, trim 411, can 501, frame 503, hanger bars 505, portions thereof, combinations thereof, and/or the like. In some embodiments, a lighting system may comprise one or more of: assembly 400, assembly 500, portions thereof, combinations thereof, and/or the like.

Downlight modules with extendable lens have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A downlight module with extendable lens, comprising:

a heat sink module that comprises a bottom-portion that is a first hollow cylindrical member that is at least substantially closed at a top-end of the bottom-portion and substantially open at a bottom-end of the bottom-portion; wherein the bottom-portion comprises a first cylindrical side-wall, such that an internal cavity is defined within the bottom-portion;

a top-inner cylinder that is a second hollow cylindrical member that is substantially open at both axial terminal ends of the top-inner cylinder; wherein a first outside portion of the top-inner cylinder is attached to an inside of the first cylindrical side-wall of the internal cavity;

a bottom-outer telescopic cylinder that is a third hollow cylindrical member that is substantially open at both axial terminal ends of the bottom-outer telescopic cylinder;

a telescopic holder that is a fourth hollow cylindrical member that is substantially open at both axial terminal ends of the telescopic holder; wherein an inside portion of the telescopic holder is attached to an outside portion of the first cylindrical side-wall; wherein exterior portions of the bottom-outer telescopic cylinder, the top-inner cylinder, and the bottom-portion are located within the telescopic holder;

a fixed lens that is disposed at least partially within the internal cavity and disposed within the top-inner cylinder; wherein the fixed lens is positionally fixed and non-movable with respect to the telescopic holder, the top-inner cylinder, and the heat sink module; and the extendable lens that is located within the bottom-outer telescopic cylinder;

wherein an inside portion of the bottom-outer telescopic cylinder is operatively linked with a second outside portion of the top-inner cylinder, such that the bottom-outer telescopic cylinder is translatable in an up or a down motion that is substantially parallel with a common axial centerline of the downlight module with the extendable lens in an assembled configuration.

2. The downlight module with the extendable lens according to claim 1, wherein the operative linkage between the inside portion of the bottom-outer telescopic cylinder and second outside portion of the top-inner cylinder is from a threaded connection, such that the up or the down motion is generated by rotating the bottom-outer telescopic cylinder around the common axial centerline.

3. The downlight module with the extendable lens according to claim 1, wherein the operative linkage between the inside portion of the bottom-outer telescopic cylinder and second outside portion of the top-inner cylinder is from a friction fit, such that the up or the down motion is generated by pushing or pulling on the bottom-outer telescopic cylinder.

4. The downlight module with the extendable lens according to claim 1, wherein the up or the down motion is limited to a predetermined range of motion from a minimum extension to a maximum extension of the bottom-outer telescopic cylinder.

5. The downlight module with the extendable lens according to claim 4, wherein when the downlight module with the extendable lens is in the minimum extension configuration a bottom axial terminal end of the bottom-outer telescopic cylinder is extended beyond a bottom flange of the telescopic holder a first fixed distance; and wherein when the downlight module with the extendable lens is in the maximum extension configuration the bottom axial terminal end of the bottom-outer telescopic cylinder is extended further beyond the bottom flange of the telescopic holder to a second fixed distance, wherein the second fixed distance is greater than the first fixed distance.

6. The downlight module with the extendable lens according to claim 1, wherein an outside diameter of the extendable lens is sized and an inside diameter of the top-inner cylinder is sized, such that the extendable lens cannot pass inside of the top-inner cylinder.

7. The downlight module with the extendable lens according to claim 1, wherein the bottom-outer telescopic cylinder comprises a lens-interaction structure that prevents an outside diameter of the extendable lens from passing beyond a bottom axial terminal end of the bottom-outer telescopic cylinder.

8. The downlight module with the extendable lens according to claim 7, wherein a bottom center of the extendable lens does extend beyond the bottom axial terminal end of the bottom-outer telescopic cylinder.

9. The downlight module with the extendable lens according to claim 1, wherein the extendable lens is movable in the up or the down direction with respect to the telescopic holder, the top-inner cylinder, the fixed lens, and the heat sink module.

10. The downlight module with the extendable lens according to claim 1, wherein the first outside portion of the top-inner cylinder is a top flange that is located at a top of the top-inner cylinder; wherein the second outside portion of the top-inner cylinder is an annular ring; wherein the annular ring is disposed between the top flange and an axial bottom terminal end of the top-inner cylinder.

11. The downlight module with the extendable lens according to claim 10, wherein the annular ring is located closer to the top flange than to the axial bottom terminal end of the top-inner cylinder.

12. The downlight module with the extendable lens according to claim 1, wherein the downlight module with the extendable lens further comprises a light-emitting-diode chip that is configured to emit light upon receiving electrical power; wherein the fixed lens is disposed between the light-emitting-diode chip and the extendable lens, with the light-emitting-diode chip being located closest to the top-end of the bottom-portion.

13. The downlight module with the extendable lens according to claim 12, wherein the downlight module with the extendable lens further comprises a LED chip holder, wherein the light-emitting-diode chip is coupled to the LED chip holder.

14. The downlight module with the extendable lens according to claim 13, wherein the fixed lens is coupled to the LED chip holder.

15. The downlight module with the extendable lens according to claim 13, wherein the downlight module with the extendable lens further comprises a mounting plate, wherein the mounting plate is attached the bottom-portion within the internal cavity; wherein the LED chip holder is attached to the mounting plate.

16. The downlight module with the extendable lens according to claim 1, wherein the heat sink module comprises a top-portion that is located above and integrally attached to the bottom-portion, wherein the top-portion comprises a plurality of heat dissipation fins.

17. The downlight module with the extendable lens according to claim 16, wherein the top-portion comprises at least one hole that is configured to provide a means for attachment of a driver cap to the top-portion, wherein the driver cap is configured to provide electrical power to a light-emitting-diode chip of the downlight module with the extendable lens.

18. The downlight module with the extendable lens according to claim 1, wherein the telescopic holder comprises a bottom flange that is configured to be attached to a trim.

19. The downlight module with the extendable lens according to claim 1, wherein the telescopic holder comprises a second cylindrical side-wall, wherein the second cylindrical side-wall comprises at least one through hole that is configured to receive a set screw to positionally fix the telescopic holder to the bottom-portion.

20. The downlight module with the extendable lens according to claim 1, wherein a top of the top-inner cylinder is located higher than a top of the bottom-outer telescopic cylinder, wherein a bottom of the bottom-outer telescopic cylinder is located lower than a bottom of the top-inner cylinder with respect to the assembled configuration of the downlight module with the extendable lens.

* * * * *